US009261834B2

(12) United States Patent
Yonekubo et al.

(10) Patent No.: US 9,261,834 B2
(45) Date of Patent: Feb. 16, 2016

(54) FIXING DEVICE HAVING CYLINDRICAL ROTATABLE MEMBER WITH ELECTROCONDUCTIVE LAYER, MAGNETIC MEMBER IN A HOLLOW PORTION OF THE MEMBER, AND COIL WOUND OUTSIDE MAGNETIC MEMBER

(71) Applicant: CANON KABUSHIKI KAISHA, Tokyo (JP)

(72) Inventors: Hideaki Yonekubo, Suntou-gun (JP); Hisashi Nakahara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/573,450

(22) Filed: Dec. 17, 2014

(65) Prior Publication Data

US 2015/0168896 A1 Jun. 18, 2015

(30) Foreign Application Priority Data

Dec. 18, 2013 (JP) ..... 2013-261302

(51) Int. Cl.
*G03G 15/20* (2006.01)

(52) U.S. Cl.
CPC ..... *G03G 15/2053* (2013.01); *G03G 15/2057* (2013.01); *G03G 2215/2035* (2013.01)

(58) Field of Classification Search
CPC ..... G03G 15/2053
See application file for complete search history.

(56) References Cited

U.S. PATENT DOCUMENTS 6,021,303 A * 2/2000 Terada et al. ..... 399/328
7,203,438 B2 4/2007 Omata et al.
8,532,554 B2 9/2013 Uchiyama et al.
8,755,705 B2 6/2014 Nakahara et al.
2012/0020709 A1 1/2012 Uchiyama et al.
2015/0132035 A1* 5/2015 Nishizawa et al. ..... 399/329
2015/0168880 A1* 6/2015 Jota et al.
2015/0168881 A1* 6/2015 Obata et al.
2015/0168889 A1* 6/2015 Kita et al.

FOREIGN PATENT DOCUMENTS

JP 2004-341164 A 12/2004
JP 2005-203272 A 7/2005
JP 2006-126410 A 5/2006

OTHER PUBLICATIONS

U.S. Appl. No. 14/539,262, dated Nov. 12, 2014.
U.S. Appl. No. 14/541,583, dated Nov. 14, 2014.

* cited by examiner

*Primary Examiner* — G. M. Hyder
(74) *Attorney, Agent, or Firm* — Fitzpatrick, Cella, Harper & Scinto

(57) ABSTRACT

A fixing device includes a rotatable member having an electroconductive layer; a magnetic member which does not form a loop outside the electroconductive layer; a coil helically wound outside said magnetic member, wherein the coil forms an AC magnetic field by a flow of a current therethrough to cause the electroconductive layer to generate heat through electromagnetic induction heating; and a back-up member. When a circumferential direction resistance R of the electroconductive layer is represented by the following formula (1), a frequency f of the AC magnetic field and the circumferential direction resistance R satisfy the following formula (2):

$$R=\rho\times 2\pi r/tw \quad (1)$$

$$f/R\geq 15 \text{ (kHz/milliohm)} \quad (2)$$

where with respect to the electroconductive layer, ρ is a volume resistivity at a fixing temperature, t is a thickness, r is a radius, and w is a length with respect to a generatrix direction of the rotatable member.

7 Claims, 27 Drawing Sheets

$$|X_e| = \frac{1}{\sqrt{\left(\frac{1}{6^2R}\right)^2+\left(\frac{1}{\omega M_e}\right)^2}} \qquad |X_c| = \frac{1}{\sqrt{\left(\frac{1}{6^2R}\right)^2+\left(\frac{1}{\omega M_c}\right)^2}}$$

$$|X_e| = \frac{1}{\sqrt{\left(\frac{1}{7^2R}\right)^2+\left(\frac{1}{\omega M_e}\right)^2}} \qquad |X_c| = \frac{1}{\sqrt{\left(\frac{1}{4^2R}\right)^2+\left(\frac{1}{\omega M_c}\right)^2}}$$

(a)

a1 : RADIUS OF CORE
a2 : INNER DIAMETER
a3 : OUTER DIAMETER
μ0 : AIR PERMEABILITY
μ1 : CORE PERMEABILITY
μ2 : LAYER PERMEABILITY (b)

(a)

(b)

(a)

(b)

FIXING DEVICE HAVING CYLINDRICAL ROTATABLE MEMBER WITH ELECTROCONDUCTIVE LAYER, MAGNETIC MEMBER IN A HOLLOW PORTION OF THE MEMBER, AND COIL WOUND OUTSIDE MAGNETIC MEMBER

FIELD OF THE INVENTION AND RELATED ART

The present invention relates to a fixing device of an electromagnetic induction heating type, to be mounted in an image forming apparatus such as an electrophotographic copying machine or an electrophotographic printer.

As the fixing device to be mounted in the electrophotographic copying machine or printer, the fixing device of the electromagnetic induction heating type has been known. Japanese Laid-Open Patent Application (JP-A) 2005-203272 discloses a constitution in which an exciting coil for generating magnetic flux is opposed to an outside of a fixing sleeve and in which a magnetic material is provided inside and outside the fixing sleeve. By employing such a constitution, the temperature distribution of the fixing sleeve is made uniform.

In the fixing device of the electromagnetic induction heating type, in order to downsize the device, it has been required that a heat generation distribution of the sleeve can be made uniform while making lengths of a magnetic core material and the exciting coil not more than a length of the sleeve.

SUMMARY OF THE INVENTION

A principal object of the present invention is to provide a fixing device capable of not only being downsized by making lengths of a magnetic core material and a coil shorter than a length of a sleeve but also making the heat generation distribution uniform with respect to a longitudinal direction of the sleeve to stabilize the heat generation distribution.

According to an aspect of the present invention, there is provided a fixing device for fixing an image on a recording material by heating the image while feeding, through a nip, the recording material on which the image is formed. The fixing device comprises: a cylindrical rotatable member having an electroconductive layer; a magnetic member inserted into a hollow portion of the rotatable member and not forming a loop outside the electroconductive layer; a coil helically wound outside the magnetic member at the hollow portion and forming an AC magnetic field by a flow of a current therethrough to cause the electroconductive layer to generate heat through electromagnetic induction heating; and a backup member for forming the nip together with the rotatable member. When a circumferential direction resistance R of the electroconductive layer is represented by the following formula (1), a frequency f of the AC magnetic field and the circumferential direction resistance R satisfy the following formula (2):

$$R=\rho\times 2\pi r/tw \quad (1)$$

$$f/R\geq 15 \text{ (kHz/milliohm)} \quad (2)$$

where ρ is a volume resistivity of the electroconductive layer at a fixing temperature, t is a thickness of the electroconductive layer, r is a radius of the electroconductive layer, and w is a length of the electroconductive layer with respect to a generatrix direction of the rotatable member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described specifically with reference to the drawings. Although the following embodiments are examples of preferred embodiments of the present invention, the present invention is not limited thereto, but constitutions thereof can also be replaced with other known constitutions within the scope of the concept of the present invention.

Embodiment 1

1. Image Forming Apparatus 100

Figure 1:
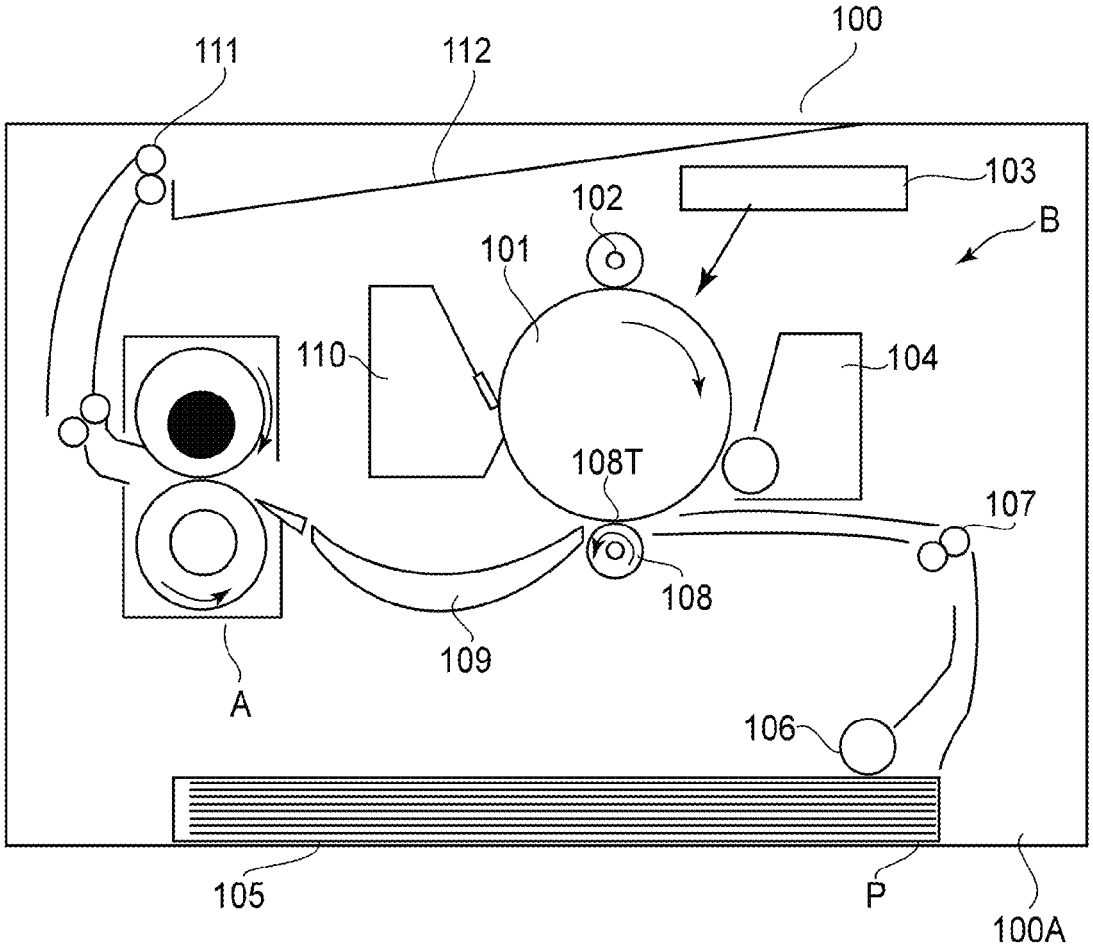
FIG. 1 is a sectional view of an image forming apparatus.

With reference to FIG. 1, an image forming apparatus 100 according to the present invention in which a fixing device A is mounted will be described. FIG. 1 is a sectional view showing a general structure of the image forming apparatus 100 (monochromatic printer in this embodiment) using electrophotographic technology.

In the image forming apparatus 100, an image forming portion B for forming a toner image on a recording material P includes a photosensitive drum 101 as an image bearing member, a charging member 102, a laser scanner 103 and a developing device 104. The image forming portion B further includes a cleaner 110 for cleaning the photosensitive drum 101, and a transfer member 108. The operation of the image forming portion B is well known and therefore a detailed description thereof will be omitted.

The recording material P accommodated in a cassette 105 in a main assembly 100A of the image forming apparatus 100 is fed one by one by rotation of a roller 106. The recording material P is fed by rotation of a roller 107 to a transfer nip 108T formed by the photosensitive drum 101 and a transfer member 108. The recording material P on which a (unfixed) toner image ((unfixed) image) is transferred at the transfer nip 108T is sent to the fixing device (fixing portion) A via a feeding guide 109, in which the toner image is heat-fixed on the recording material P by the fixing device A. The recording material P coming out of the fixing device A is discharged onto a tray 113 by rotation of a roller 111.

2. Fixing Device A

Figure 2:
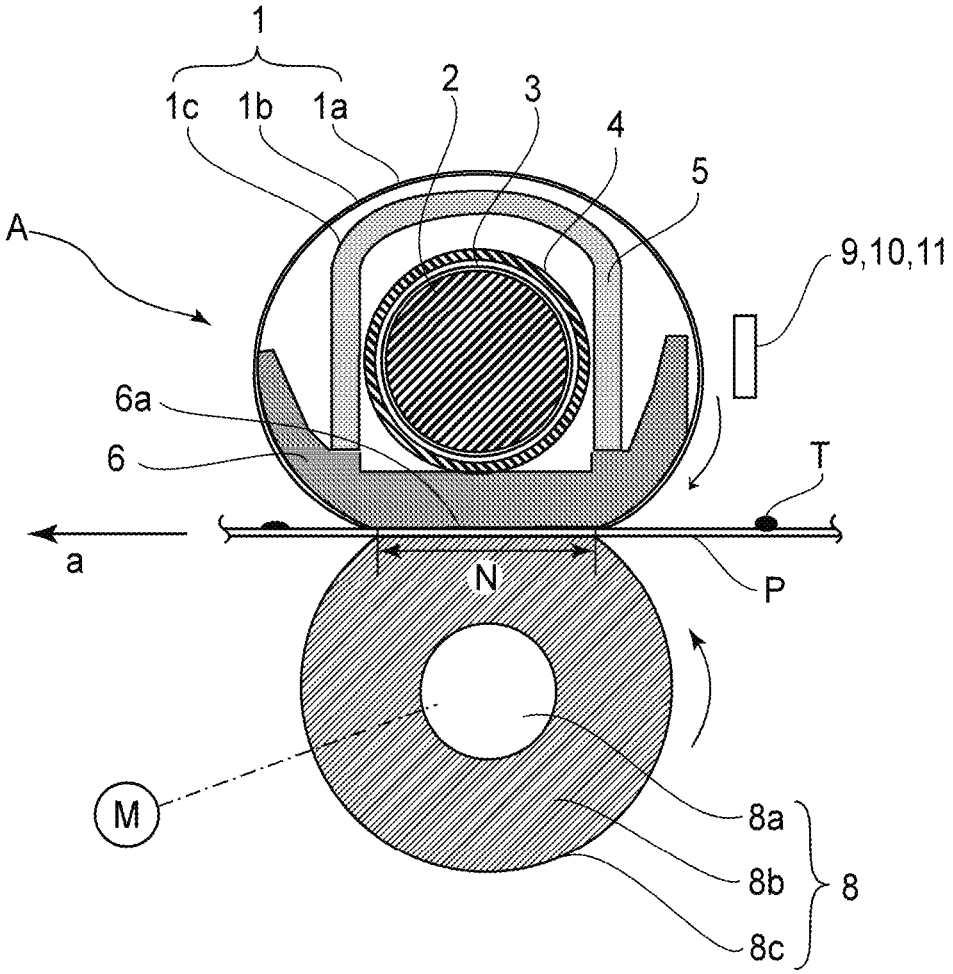
FIG. 2 is a sectional view of a fixing device according to Embodiment 1.
Figure 3:
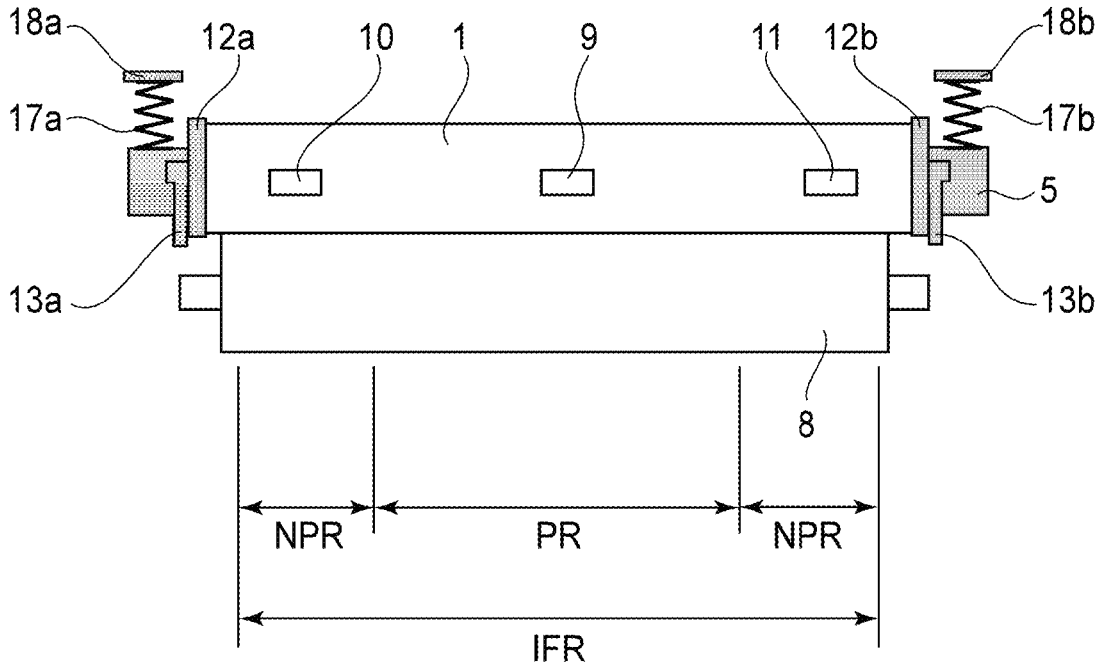
FIG. 3 is a front view of the fixing device in Embodiment 1.

The fixing device A in this embodiment will be described with reference to FIGS. 2 and 3. FIG. 2 shows a sectional view of a general structure of an example of the fixing device A of an electromagnetic induction heating type in this embodiment, and showing a layer structure of a sleeve 1 of the fixing device A. FIG. 3 is a front view of the fixing device A (FIG. 2) as seen from a recording material feeding side.

The fixing device A in this embodiment includes the sleeve 1 as a cylindrical rotatable member and a pressing roller 8 as a pressing member.

The pressing roller 8 includes a metal core 8*a*, a heat-resistant elastic (material) layer 8*b* formed at an outer peripheral surface of the metal core$_{metal}$ 8*a* between longitudinal shaft end portions of the metal core 8*a*, and a parting layer (surface layer) 8*c* formed at an outer peripheral surface of the elastic layer 8*b*. A longitudinal direction refers to a direction perpendicular to a recording material feeding direction a. As a material for the elastic layer 8*b*, a material having a good heat-resistant property, such as a silicone rubber, a fluorine-containing rubber or a fluorosilicone rubber may preferably be used. Each of the longitudinal shaft end portions of the metal core 8*a* is rotatably supported by an unshown frame via a bearing.

The sleeve 1 has a cylindrical shape of 10 mm to 50 mm in diameter. The layer structure of the sleeve 1 is a composite structure consisting of a heat generating layer (electroconductive layer) 1*a* formed as a base layer of an electroconductive member, an elastic layer 1*b* formed on an outer surface of the heat generating layer 1*a*, and a parting layer 1*c* formed on an outer surface of the elastic layer 1*b*.

The heat generating layer 1*a* is a metal film of 10-70 μm in thickness, and the elastic layer 1*b* is molded with silicone rubber in a thickness of 0.1 mm to 0.3 mm so as to have a hardness of 20 degrees (JIS-A hardness under application of a load of 1 kg). On the outer surface of the elastic layer 1*b*, as a parting layer (surface layer) 1*c*, a fluorine-containing resin tube was coated in a thickness of 10 μm to 50 μm.

Into a hollow portion of the sleeve 1, a magnetic core as a magnetic core material, an exciting coil 3 as a magnetic field generating means, a stay 5 as a reinforcing member, and a nip forming member 6 are inserted.

The nip forming member 6 prepared by a heat-resistant resin material, such as PPS, opposes the pressing roller 8 via the sleeve 1. Further, the nip forming member 6 supports the magnetic core 2 along a longitudinal direction of the sleeve 1 in an opposite side of the pressing roller 8. A metal-made stay 5 disposed on the nip forming member 6 so as to cover the magnetic core 2 is supported by the frame at one and the other end portions thereof with respect to a longitudinal direction thereof.

At the one and the other end portions of the stay 5, pressing springs 17*a* and 17*b* are compressedly provided between the frame and spring receiving members 18*a* and 18*b* (FIG. 3). Further, the nip forming member 6 is pressed in a vertical direction perpendicular to a generatrix direction of the pressing roller 8 by the pressing springs 17*a* and 17*b* via the stay 5. In this embodiment, a pressure of about 100 N to about 250 N (10 kgf to 25 kgf) in total pressure is applied to the nip forming member 6. By the pressure of the pressing springs 17*a* and 17*b*, a flat surface 6*a* of the nip forming member 6 is pressed against the surface of the pressing roller 8 via the sleeve 1. As a result, the elastic layer 8*b* of the pressing roller 8 is elastically deformed, so that a nip N having a predetermined width is formed by the sleeve surface and the pressing roller surface.

Flange members 12*a* and 12*b* are mounted in one longitudinal end side and the other longitudinal end side, respectively, on the nip forming member 6 (FIG. 3). The flange member 12*a* performs the function of limiting movement of the sleeve 1 in the longitudinal direction by receiving a one longitudinal end portion of the sleeve 1 when the sleeve 1 moves toward one longitudinal end side during rotation of the sleeve 1. The flange 12*b* performs the function of limiting movement of the sleeve 1 in the longitudinal direction by receiving the other longitudinal end portion of the sleeve 1 when the sleeve 1 moves toward the other longitudinal end side during the rotation of the sleeve 1. As a material for the flange members 12*a* and 12*b*, a material, such as a LCP (liquid crystal polymer), having a good heat-resistant property may preferably be used.

The position of the flange 12*a* is regulated by a regulating member 13*a*, and the position of the flange 12*b* is regulated by a regulating member 13*b*. Each of the regulating members 13*a* and 13*b* is supported by the frame.

Figure 4:
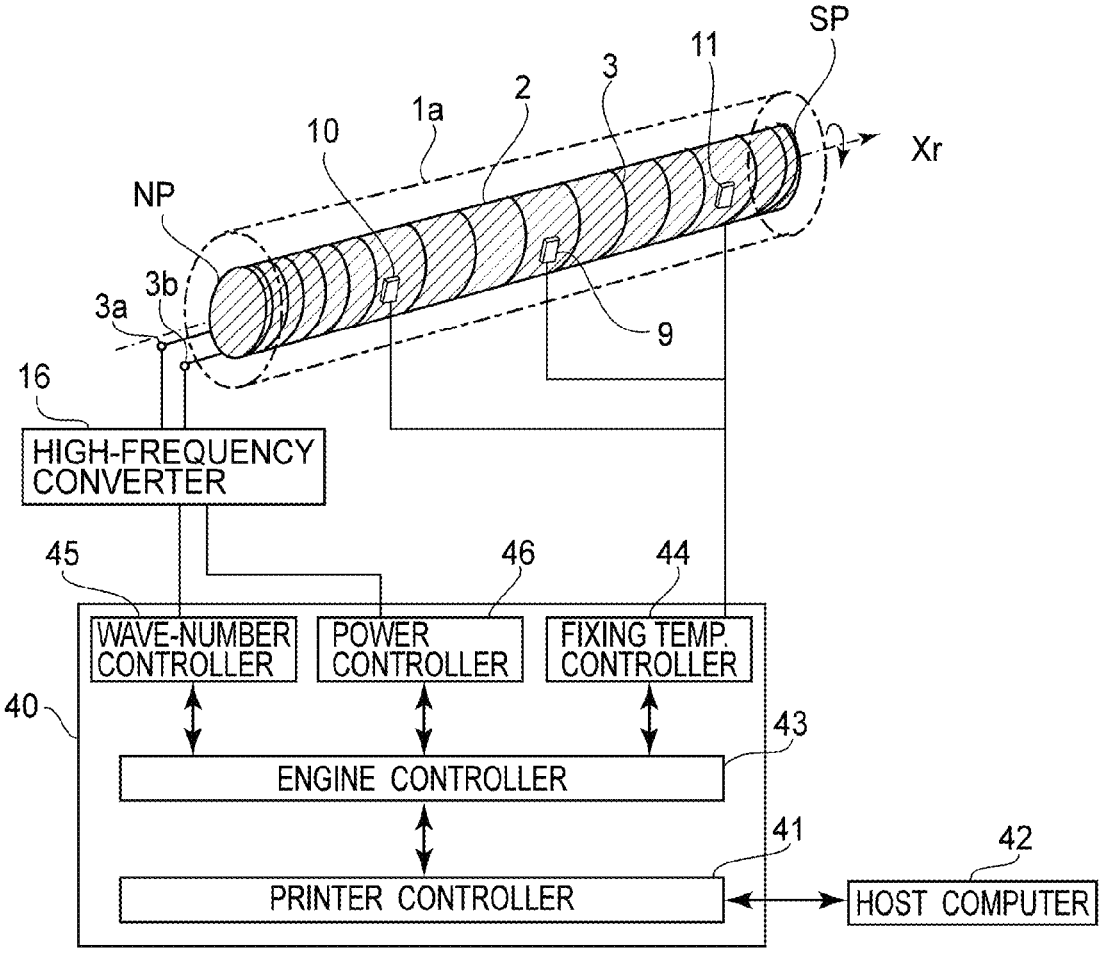
FIG. 4 is a perspective view of a principal part of the fixing device in Embodiment 1.

FIG. 4 is a perspective view showing a positional relationship among the heat generating layer 1*a* of the sleeve 1, the magnetic core 2 and the exciting coil 3.

The magnetic core 2 formed in a cylindrical shape is disposed so as to penetrate through a hollow portion of the sleeve 1 and is fixed by an unshown fixing means, so that a rectilinear open magnetic path having magnetic poles NP and SP is formed. As a material for the magnetic core 2, a material having low hysteresis loss and high relative permeability may preferably be used. For example, it is preferable that at least one material is selected from the group consisting of oxides and alloy materials including pure iron, electromagnetic steel plate, cintered ferrite, ferrite resin, dust core, amorphous alloy, and permalloy. In this embodiment, cintered ferrite having a relative permeability of 1800 is used. The magnetic core 2 has a cylindrical shape of 5-30 mm in diameter. The magnetic core 2 is 340 mm in longitudinal length (longitudinal dimension).

Figure 5:
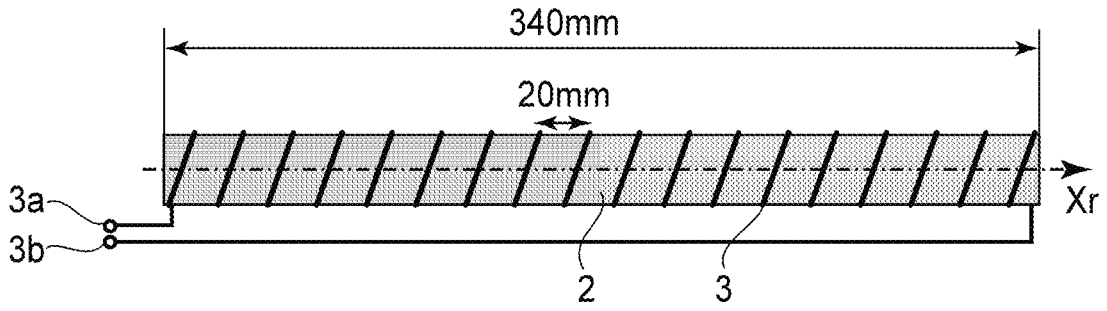
FIG. 5 is a schematic view showing a winding interval of an exciting coil.

FIG. 5 is a schematic view for illustrating a manner of winding of the exciting coil 3. The exciting coil 3 is formed by helically winding an ordinary single lead wire around the magnetic core 2 at the hollow portion of the sleeve 1. Around the magnetic core 2 having the longitudinal dimension of 340 mm, the exciting coil 3 is wound 18 times at a uniform pitch of 20 mm as a winding interval with respect to a direction crossing a rotational axis Xr of the sleeve 1. A high-frequency current is passed through the exciting coil 3 via energization contact portions 3*a* and 3*b* by a high-frequency converter 16, so that a magnetic flux is generated.

With reference to (a) of FIG. 35, the heat-generating mechanism of the fixing devices A in this embodiment will be described specifically.

The magnetic lines of force (indicated by dots) generated by passing the AC current through the exciting coil 3 pass through the inside of the magnetic core 2 inside the cylindrical heat generating layer 1*a* in the generatrix direction (a direction from S toward a direction N). Then, the magnetic lines of force move to the outside of the heat generating layer 1*a* from one end (N) of the magnetic core 2 and return to the other end (S) of the magnetic core 2. As a result, the induced electromotive force for generating magnetic lines of force directed in a direction of preventing an increase and a decrease of magnetic flux penetrating the inside of the heat generating layer 1*a* in the generatrix direction of the heat generating layer 1*a* is generated in the heat generating layer 1*a*, so that the current is indicated along a circumferential direction of the heat generating layer 1*a*. By the Joule heat due to this induced current, the heat generating layer 1*a* generates heat. For convenience, the heat generating layer is hereinafter referred to as an electroconductive layer.

The magnitude of the induced electromotive force V generated in the electroconductive layer 1*a* is proportional to a change amount per unit time ($\Delta\phi/\Delta t$) of the magnetic flux passing through the inside of the electroconductive layer 1*a* and the winding number of the coil as shown in the following formula (500).

$$V = -N\frac{\Delta\Phi}{\Delta t} \tag{500}$$

Figure 35:
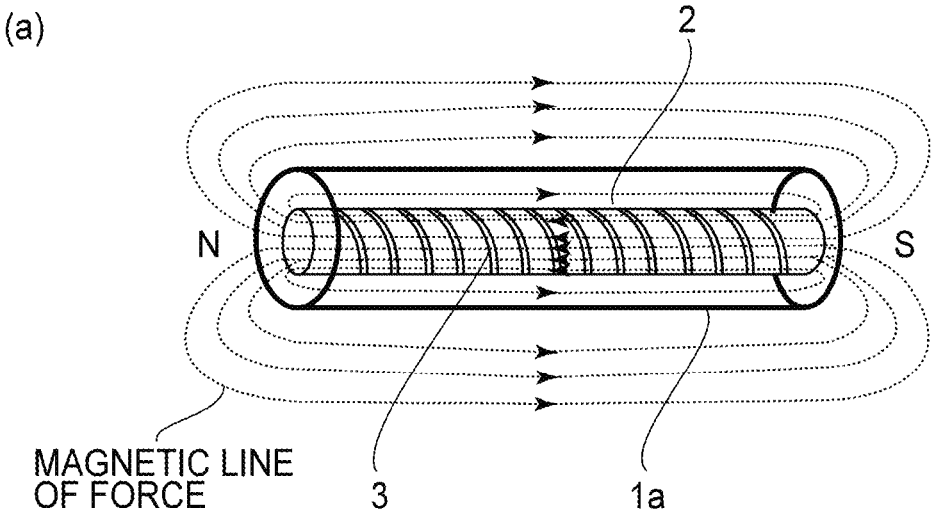
In FIG. 35, (a) and (b) are schematic views for illustrating a heat generation mechanism.
Figure 35:
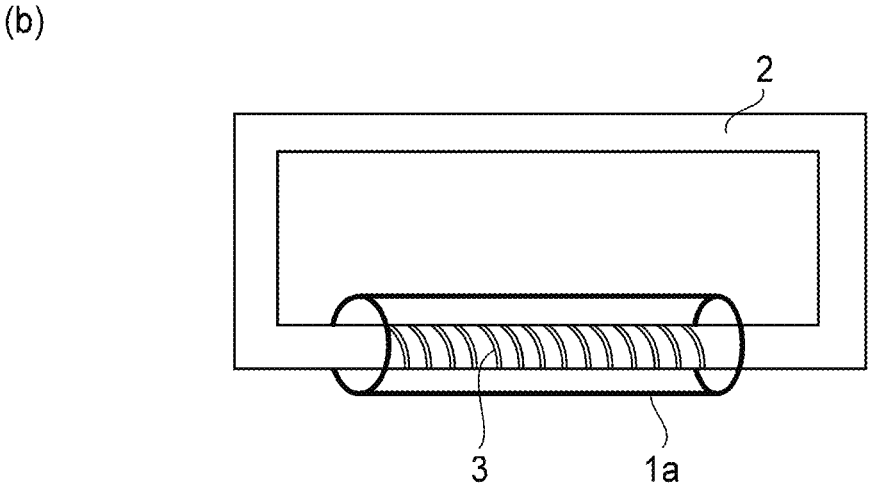

The magnetic core 2 in (a) of FIG. 35 does not form a loop and has a shape having end portions. As shown in (b) of FIG. 35, the magnetic lines of force in the fixing device in which the magnetic core 2 forms a loop outside the electroconductive layer 1*a* come out from the inside to the outside of the electroconductive layer 1*a* by being induced in the magnetic core 2 and then return to the inside of the electroconductive layer 1*a*.

However, as in this embodiment, in the case of the constitution in which the magnetic core 2 has the end portions, the magnetic lines of force coming out of the end portions of the magnetic core 2 are not induced. For this reason, with respect to a path (from N to S) in which the magnetic lines of force coming out of one end of the magnetic core 2 return to the other end of the magnetic core 2, there is a possibility that the magnetic lines of force pass through both of an outside route in which the magnetic lines of force pass through the outside of the electroconductive layer 1*a* and an inside route in which the magnetic lines of force pass through the inside of the electroconductive layer 1*a*. Hereinafter, a route in which the magnetic lines of force pass through the outside of the electroconductive layer 1*a* from N toward S of the magnetic core 2 is referred to as the outside route, and a route in which the magnetic lines of force pass through the inside of the electroconductive layer 1*a* from N toward S of the magnetic core 2 is referred to as the inside route.

Of the magnetic lines of force coming out of one end of the magnetic core 2, the proportion of the magnetic lines of force passing through the outside route correlates with electric power (conversion efficiency of electric power), consumed by the heat generation of the electroconductive layer 1*a*, of electric power supplied to the exciting coil 3, and is an important parameter. With an increasing proportion of the magnetic lines of force passing through the outside route, the electric power (conversion efficiency of electric power), consumed by the heat generation of the electroconductive layer 1*a*, of the electric power supplied to the exciting coil 3 becomes higher.

The reason, therefore, is that the principle thereof is the same as the phenomenon that the conversion efficiency of the electric power becomes high when leakage flux is sufficiently small in a transformer and the number of magnetic fluxes passing through the inside of primary winding of the transformer and the number of magnetic fluxes passing through the inside of secondary winding of the transformer are equal to each other. That is, in this embodiment, the conversion efficiency of the electric power becomes higher as the number of the magnetic fluxes passing through the inside of the magnetic core 2 and the number of magnetic fluxes passing through the outside route become closer, so that the high-frequency current passed through the exciting coil 3 can be efficiently subjected to, as the circumferential direction current, electromagnetic induction.

In (a) of FIG. 35, the magnetic lines of force passing through the inside of the magnetic core 2 from S toward N and the magnetic lines of force passing through the inside route are opposite in direction to each other, and therefore, these magnetic lines of force cancel each other as the entire induction the electroconductive layers 1*a* including the magnetic core 2. As a result, the number of magnetic lines of force (magnetic fluxes) passing through the entire inside of the electroconductive layer 1*a* from S toward N decreases, so that a change amount per unit time of the magnetic flux becomes small. When the change amount per unit time of the magnetic flux decreases, the induced electromotive force generated in the electroconductive layer 1*a* becomes small, so that the heat generation amount of the electroconductive layer 1*a* becomes small.

As described above, in order to obtain the necessary electric power conversion efficiency by the fixing device A in this embodiment, control of the proportion of the magnetic lines of force passing through the outside route is important.

The proportion passing through the outside route in the fixing device A is represented using an index called permeance representing the ease of passing of the magnetic lines of force. First, a general way of thinking about a magnetic circuit will be described. A circuit of a magnetic path along which the magnetic lines of force pass is called the magnetic circuit relative to an electric circuit. When the magnetic flux is calculated in the magnetic circuit, the calculation can be made in accordance with a calculation of the current in the electric circuit. To the magnetic circuit, the Ohm's law regarding the electric direction is applicable. When the magnetic flux corresponding to the current in the electric circuit is Φ, a magnetomotive force corresponding to the electromotive force is V, and a magnetic reluctance corresponding to an electrical resistance is R, these parameter satisfy the following formula (501).

$$\Phi=V/R \tag{501}$$

However, for describing the principle in an easy-to-understood manner, a description will be provided using permeance P. When the permeance P is used, the above formula (501) can be represented by the following formula (502).

$$\Phi=V\times P \tag{502}$$

Further, when the length of the magnetic path is B, the cross-sectional area of the magnetic path is S and the permeability of the magnetic path is μ, the permeance P can be represented by the following formula (503).

$$P=\mu\times S/B \tag{503}$$

The permeance P is proportional to the cross-sectional area S and the permeability μ, and is inversely proportional to the magnetic path length B.

Figure 36:
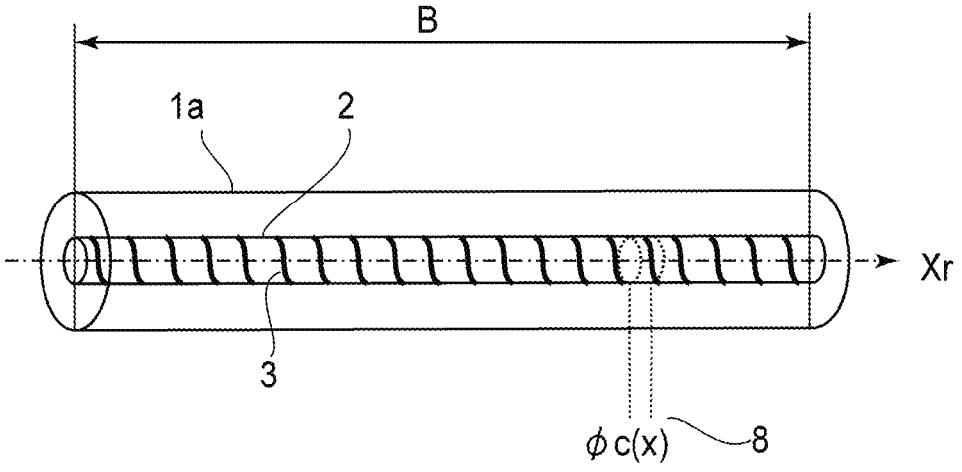
In FIG. 36, (a) and (b) are schematic views for illustrating magnetic flux.
Figure 36:
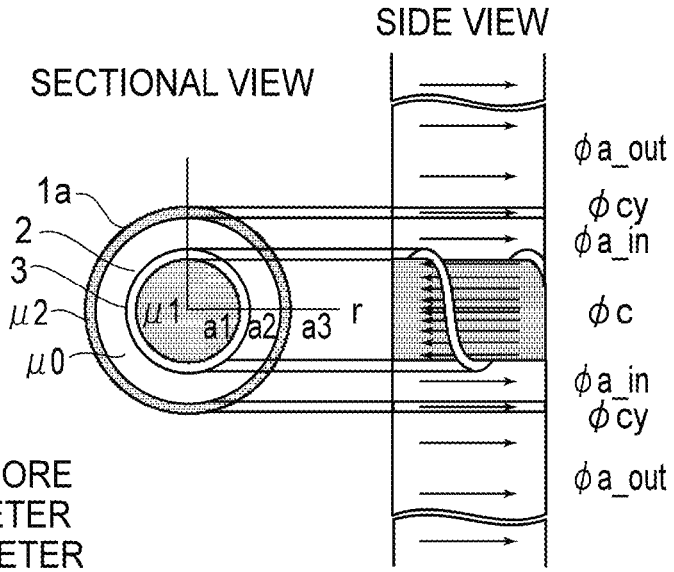

In FIG. 36, (a) is a schematic view showing the coil 3 wound N (times) around the magnetic core 2, of a1 (*m*) in radius, B (m) in length and μ1 in relative permeability, inside the electroconductive layer 1*a* in such a manner that the helical axis of the coil 3 is substantially parallel to the generatrix direction of the electroconductive layer 1*a*. In this case, the electroconductive layer 1*a* is an electroconductor of B (m) in length, a2 (*m*) in inner diameter, a3 (*m*) in outer diameter and μ2 in relative permeability. Space permeability induction outside the electroconductive layer 1*a* is μ0 (H·m). When a current I (A) is passed through the coil 3, magnetic flux 8 generated per unit length of the magnetic core 2 is ϕc (x).

In FIG. 36, (b) is a sectional view perpendicular to the longitudinal direction of the magnetic core 2. Arrows in the figure represent magnetic fluxes, parallel to the longitudinal direction of the magnetic core 2, passing through the inside of the magnetic core 2, the induction of the electroconductive layer 1*a* and the outside of the electroconductive layer 1*a* when the current I is passed through the coil 3. The magnetic flux passing through the inside of the magnetic core 2 is c(=ϕc(x)), the magnetic flux passing through the inside of the electroconductive layer 1*a* (in a region between the electroconductive layer 1*a* and the magnetic core 2) is ϕa_in, the magnetic flux passing through the electroconductive layer itself is ϕs, and the magnetic flux passing through the outside of the electroconductive layer is ϕa_out.

Figure 37:
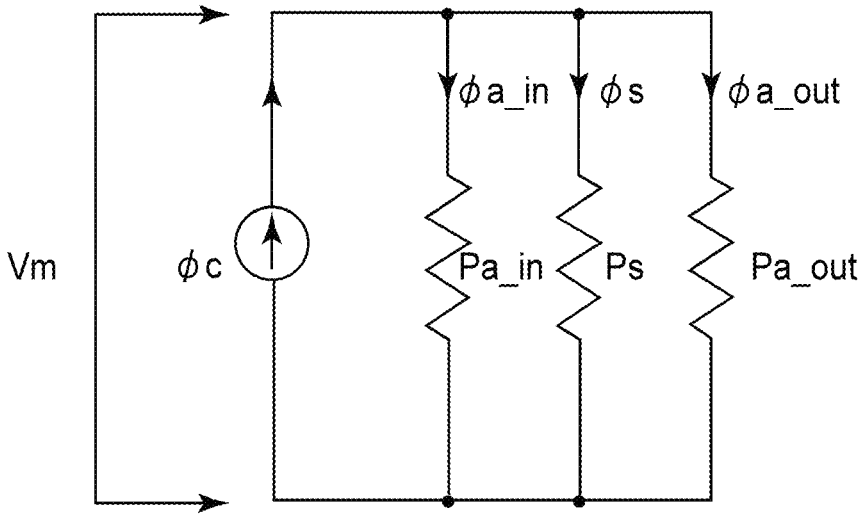
In FIG. 37, (a) and (b) are schematic views of magnetic equivalent circuits.
Figure 37:
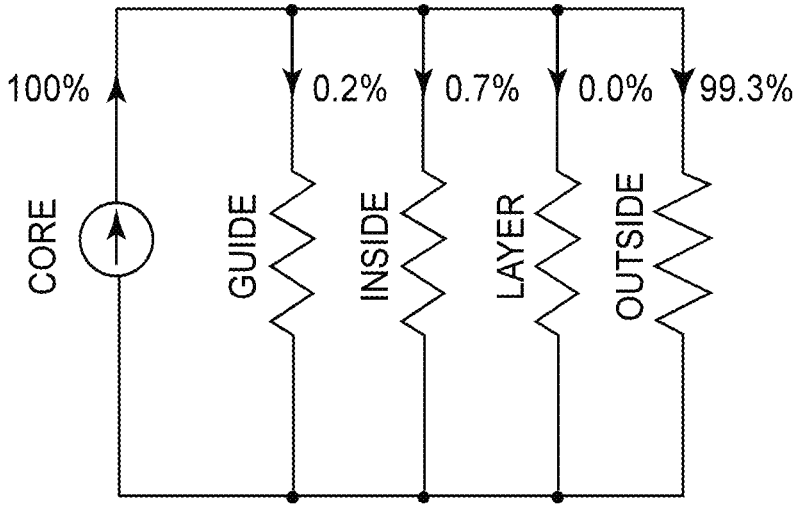

In FIG. 37, (a) shows a magnetic equivalent circuit in a space including the core 2, the coil 3 and the electroconductive layer 1*a* per unit length, which are shown in (a) of FIG. 35. The magnetomotive force generated by the magnetic flux ϕc passing through the magnetic core 2 is Vm, the permeance of the magnetic core 2 is Pc, and the permeance inside the electroconductive layer 1*a* is Pa_in. Further, the permeance in the electroconductive layer 1*a* itself of the sleeve 1 is Ps, and the permeance outside the electroconductive layer 1*a* is Pa_out.

When Pc is large enough compared with Pa_in and Ps, it would be considered that the magnetic flux coming out of one end of the magnetic core 2 after passing through the inside of the magnetic core 2 returns to the other end of the magnetic core 2 after passing through either of ϕa_in, cps and ϕa_out. Therefore, the following formula (504) holds.

$$\phi c=\phi a_\mathrm{in}+\phi s+\phi a_\mathrm{out} \tag{504}$$

Further, ϕc, ϕa_in, ϕs and ϕa_out are represented by the following formulas (505) to (508), respectively.

$$\phi c=Pc\times Vm \tag{505}$$

$$\phi s\times Vm \tag{506}$$

$$\phi a_\mathrm{in}=Pa_\mathrm{in}\times Vm \tag{507}$$

$$\phi a_\mathrm{out}=Pa_\mathrm{out}\times Vm \tag{508}$$

Therefore, when the formulas (505) to (508) are substituted into the formula (504), Pa_out is represented by the following formula (509).

$$Pc\times Vm=Pa_\mathrm{in}\times Vm+Ps\times Vm+Pa_\mathrm{out}\times Vm=(Pa_\mathrm{in}+Ps+Pa_\mathrm{out})\times Vm\therefore Pa_\mathrm{out}=Pc-Pa_\mathrm{in}-Ps \tag{509}$$

When the cross-sectional area of the magnetic core 2 is Sc, the cross-sectional area inside the electroconductive layer 1*a* is Sa_in and the cross-sectional area of the electroconductive layer 1*a* itself is Ss, referring to (b) of FIG. 36, each of Pc, Pa_in and Ps can be represented by the product of "(permeability)×(cross-sectional area)" as shown below. The unit is "H·m".

$$Pc=\mu 1\times Sc=\mu 1\times\pi(a1)^2 \tag{510}$$

$$Pa_\mathrm{in}=\mu 0\times Sa_\mathrm{in}=\mu 0\times\pi\times((a2)^2-(a1)^2) \tag{511}$$

$$Ps=\mu 2\times Ss=\mu 2\times\pi\times((a3)^2-(a2)^2) \tag{512}$$

When the formulas (510) to (512) are substituted into the formula (509), Pa_out is represented by the following formula (513).

$$\begin{aligned}\text{Pa_out} &= Pc - \text{Pa_in} - Ps \\ &= \mu 1 \times Sc - \mu 0 \times \text{Sa_in} - \mu 2 \times Ss \\ &= \Pi \times \mu 1 \times (a1)^2 - \Pi \times \mu 0 \times ((a2)^2 - (a1)^2) - \\ &\quad \Pi \times \mu 2 \times ((a3)^2 - (a2)^2)\end{aligned} \tag{513}$$

By using the above formula (513), Pa_out/Pc, which is proportional to the magnetic lines of force passing through the outside of the electroconductive layer 1*a*, can be calculated.

In place of the permeance P, the magnetic reluctance R may also be used. In the case where the magnetic reluctance R is used, the magnetic reluctance R is simply the reciprocal of the member P, and therefore the magnetic reluctance R per unit length can be expressed by "1/((permeability)×(cross-sectional area)), and the unit is "1/(H·m)".

A result of specific calculation using parameters of the fixing device A in this embodiment is shown in Table 1.

TABLE 1

| Item | U*1 | MC*2 | FG*3 | IEL*4 | EL*5 | OEL*6 |
|---|---|---|---|---|---|---|
| CSA*7 | $m^2$ | 1.5E−04 | 1.0E−04 | 2.0E−04 | 1.5E−06 | |
| RP*8 | | 1800 | 1 | 1 | 1 | |
| P*9 | H/m | 2.3E−03 | 1.3E−06 | 1.3E−06 | 1.3E−06 | |
| PUL*10 | H · m | 3.5E−07 | 1.3E−10 | 2.5E−10 | 1.9E−12 | 3.5E−07 |
| MRUL*11 | 1/(H · m) | 2.9E+06 | 8.0E+09 | 4.0E+09 | 5.3E+11 | 2.9E+06 |
| MFR*12 | % | 100.0 | 0.0 | 0.1 | 0.0 | 99.9 |

*1"U" is the unit.
*2"MC" is the magnetic core.
*3"FG" is the film guide.
*4"IEL" is the inside of the electroconductive layer.
*5"EL" is the electroconductive layer.
*6"OEL" is the outside of the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.
*12"MFR" is the magnetic flux ratio.

The magnetic core 2 is formed of ferrite (relative permeability: 1800) and is 14 (mm) in diameter and $1.5\times10^{-4}$ ($m^2$) in cross-sectional area. The nip forming member 6 is formed of PPS (polyphenylene sulfide) (relative permeability: 1.0) and is $1.0\times10^{-4}$ ($m^2$) in cross-sectional area. The electroconductive layer 1*a* is formed of aluminum (relative permeability: 1.0) and is 24 (mm) in diameter, 20 (μm) in thickness and $1.5\times10^{-6}$ ($m^2$) in cross-sectional area.

The cross-sectional area of the region between the electroconductive layer 1*a* and the magnetic core 2 is calculated by subtracting the cross-sectional area of the magnetic core 2 and the cross-sectional area of the nip forming member 6 from the cross-sectional area of the hollow portion inside the electroconductive layer 1*a* of 24 mm in diameter. The elastic layer 1*b* and the parting layer 1*c* are provided outside the electroconductive layer 1*a* and do not contribute to the heat generation. Accordingly, in a magnetic circuit model for calculating the permeance, the layers 1*b* and 1*c* can be regarded as air layers outside the electroconductive layer 21*a* and therefore there is no need to add these layers into the calculation.

From Table 1, Pc, Pa_in and Ps are values shown below.

$$Pc=3.5\times10^{-7}\ (H\cdot m)$$

$$Pa_in=1.3\times10^{-10}+2.5\times10^{-10}\ (H\cdot m)$$

$$Ps=1.9\times10^{-12}\ (H\cdot m)$$

From a formula (514) shown below, Pa_out/Pc can be calculated using these values.

$$Pa_out/Pc=(Pc-Pa_in-Ps)/Ps=0.999(99.9\%) \tag{514}$$

The magnetic core 2 is divided into a plurality of cores with respect to the longitudinal direction, and a spacing (gap) is provided between adjacent divided cores in some cases. In the case where this spacing is filled with the air or a material whose relative permeability can be regarded as 1.0 or whose relative permeability is considerably smaller than the relative permeability of the magnetic core 2, the magnetic reluctance R of the magnetic core 2 as a whole becomes large, so that the function of inducing the magnetic lines of force degrades.

The calculating method of the permeance of the magnetic core 2 divided in the plurality of cores described above becomes complicated. In the following, a calculating method of the permeance of a whole of the magnetic core 2 in the case where the magnetic core 2 is divided into the plurality of cores which are equidistantly arranged via the spacing or the sheet-like non-magnetic material will be described. In this case, the magnetic reluctance over a the entire longitudinal length is derived and then is divided by the entire longitudinal length to obtain the magnetic reluctance per unit length, and thereafter there is a need to obtain the permeance per unit length using the reciprocal of the magnetic reluctance per unit length.

Figure 38:
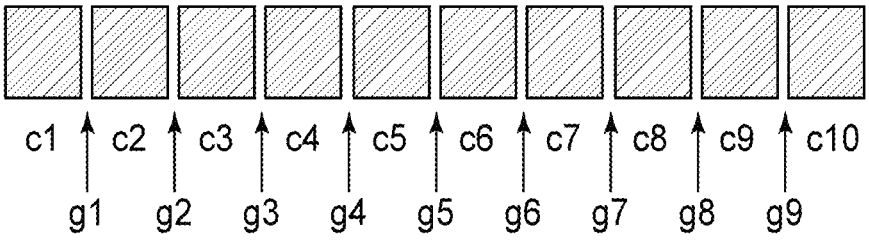
FIG. 38 is a schematic view of the magnetic core with respect to a longitudinal direction.

First, a schematic view of the magnetic core 2 with respect to the longitudinal direction is shown in FIG. 38. Each of magnetic cores c1 to c10 is Sc in cross-sectional area, μc in permeability and Lc in width, and each of gaps g1 to g9 is Sg in cross-sectional area, μg in permeability and Lg in width. The total magnetic reluctance Rm_all of these magnetic cores with respect to the longitudinal direction is given by the following formula (515).

$$\begin{aligned}\text{Rm_all} &= (\text{Rm_c1} + \text{Rm_c2} + \ldots + \text{Rm_c10}) + \\ &\quad (\text{Rm_g1} + \text{Rm_g2} + \ldots + \text{Rm_g9})\end{aligned} \tag{515}$$

In this case, the shape, the material and the gap width of the respective magnetic cores are uniform, and therefore when the sum of values of Rm_c is ΣRm_c, and the sum of values of Rm_g is ΣRm_g, the respective magnetic reluctances can be represented by the following formulas (516) to (518).

$$Rm_all=(\Sigma Rm_c)+(\Sigma Rm_g) \tag{516}$$

$$Rm_c=Lc/(\mu c\times Sc) \tag{517}$$

$$Rm_g=Lg/(\mu g\times Sg) \tag{518}$$

By substituting the formulas (517) and (518) into the formula (516), the magnetic reluctance Rm_all over the longitudinal full length can be represented by the following formula (519).

$$\begin{aligned}\text{Rm_all} &= (\Sigma\text{Rm_c}) + (\Sigma\text{Rm_g}) \\ &= (Lc/(\mu c\times Sc))\times 10 + (Lg/(\mu g\times Sg))\times 9\end{aligned} \tag{519}$$

When the sum of values of Lc is ΣLc and the sum of values of Lg is ΣLg, the magnetic reluctance Rm per unit length is represented by the following formula (520).

$$\begin{aligned}Rm &= \text{Rm_all}/(\Sigma Lc + \Sigma Lg) \\ &= \text{Rm_all}/(L\times 10 + Lg\times 9)\end{aligned} \tag{520}$$

From the above, the permeance Pm per unit length is obtained from the following formula (521).

$$\begin{aligned}Pm &= 1/Rm \\ &= (\Sigma Lc + \Sigma Lg)/\text{Rm_all} \\ &= (\Sigma Lc + \Sigma Lg)/[\{\Sigma Lc/(\mu c + Sc)\} + \{\Sigma Lg/(\mu g + Sg)\}]\end{aligned} \tag{521}$$

An increase in gap Lg leads to an increase in magnetic reluctance (i.e., a lowering in permeance) of the magnetic core 2. When the fixing device 110 in this embodiment is constituted, on a heat generation principle, it is desirable that the magnetic core 2 is designed so as to have a small magnetic reluctance (i.e., a large permeance), and therefore it is not so desirable that the gap is provided. However, in order to prevent breakage of the magnetic core 2, the gap is provided by dividing the magnetic core 2 into a plurality of cores in some cases.

As described above, the proportion of the magnetic lines of force passing through the outside route can be represented using the permeance or the magnetic reluctance.

2-4) Conversion Efficiency of Electric Power Necessary for Fixing Device

Next, the conversion efficiency of the electric power necessary for the fixing device in this embodiment will be described. For example, in the case where the conversion efficiency of the electric power is 80%, the remaining 20% of the electric power is converted into thermal energy by the coil, the core and the like, other than the electroconductive layer, and then is consumed. In the case where the electric power conversion efficiency is low, members, which should not generate heat, such as the magnetic core and the coil, generate heat, so that there is a need to take measures to cool the members in some cases.

Incidentally, in this embodiment, when the electroconductive layer 1*a* is caused to generate heat, the AC magnetic field is formed by passing the high-frequency current through the exciting coil 3. The AC magnetic field induces the current in the electroconductive layer 1*a*. As a physical model, this closely resembles magnetic coupling of the transformer. For that reason, when the electric power conversion efficiency is considered, it is possible to use an equivalent circuit of the magnetic coupling of the transformer. By the magnetic field, the exciting coil 3 and the electroconductive layer 1*a* cause the magnetic coupling, so that the electric power supplied to the exciting coil 3 is transmitted to the electroconductive layer 1*a*. Herein, the phrase "electric power conversion efficiency" means the ratio between the electric power supplied to the exciting coil 3, which is the magnetic field generating means, and the electric power consumed by the electroconductive layer 1*a*.

In the case of this embodiment, the electric power conversion efficiency is the ratio between the electric power supplied to the high-frequency converter 16 for the exciting coil 3 shown in FIG. 4 and the electric power consumed by the electroconductive layer 1*a*. The electric power conversion efficiency can be represented by the following formula (522).

(Electric power conversion efficiency)=(electric power consumed by electroconductive layer)/(electric power supplied to exciting coil) (522)

The electric power which is supplied to the exciting coil 3 and which is then consumed by members other than the electroconductive layer 1*a* includes the loss by the resistance of the exciting coil 3 and the loss by a magnetic characteristic of the magnetic core material.

Figure 39:
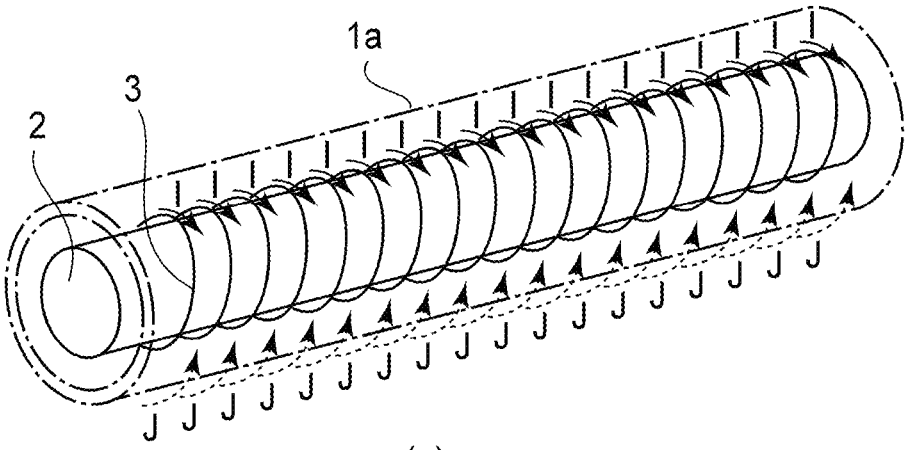
In FIG. 39, (a) and (b) are schematic views for illustrating a circuit efficiency.
Figure 39:
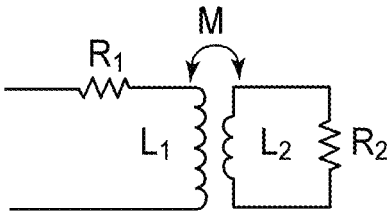

In FIG. 39, (a) and (b) are illustrations regarding the efficiency of a circuit. In (a) of FIG. 39, the exciting coil 3 is wound around the magnetic core 2 disposed inside the electroconductive layer 1*a*. In FIG. 39, (b) shows an equivalent circuit. In (b) of FIG. 39, R1 is the loss due to the exciting coil 3 and the magnetic core 2, L1 is the inductance of the exciting coil 3 wound around the magnetic core 2, M is the mutual inductance between the winding and the electroconductive layer 1*a*, L2 is the inductance of the electroconductive layer 1*a*, and R2 is the resistance of the electroconductive layer 1*a*. An equivalent circuit when the electroconductive layer 1*a* is not mounted is shown in (a) of FIG. 40. By a device such as an impedance analyzer or an LCR meter, when a series equivalent resistance R1 and an equivalent inductance L1 are measured from both ends of the exciting coil 3, an impedance ZA can be represented by the following formula (523).

$$ZA=R1+j\omega L1 \tag{523}$$

The current passing through this circuit produces a loss by R1. That is, R1 represents the loss due to the coil 3 and the magnetic core 2.

Figure 40:
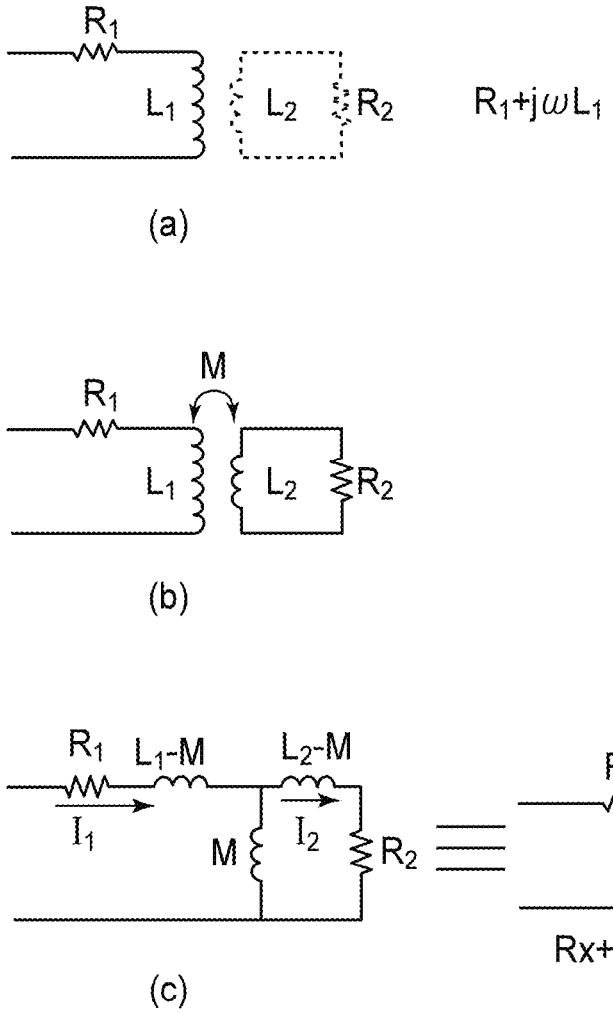
In FIG. 40, (a) to (c) are schematic views each showing an equivalent circuit.

An equivalent circuit when the electroconductive layer 1*a* is mounted is shown in (b) of FIG. 40. When a series equivalent resistance Rx and an equivalent inductance Lx during mounting of the electroconductive layer 1*a* are measured in advance, by making equivalent conversion as shown in (c) of FIG. 40, it is possible to obtain a relational expression (524).

$$\begin{aligned}Z &= R1 + j\omega(L1 - M) + \frac{j\omega M(j\omega(L2 - M) + R2)}{j\omega M + j\omega(L2 - M) + R2} \\ &= R1 + \frac{\omega^2 M^2 R_2}{R_2^2 + \omega^2 L_2^2} + j\left(\omega(L_1 - M) + \frac{M\cdot R_2^2 + \omega^2 M L_2(L_2 - M)}{R_2^2 + \omega^2 L_2^2}\right.\end{aligned} \tag{524}$$

-continued $$Rx = R_1 + \frac{\omega^2 M^2 R_s}{R_2^2 + \omega^2 L_2^2} \tag{525}$$

$$Lx = \omega(L_1 - M) + \frac{M \cdot R_2^2 + \omega^2 M L_2 (L_2 - M)}{R_2^2 + \omega^2 L_2^2}\Big) \tag{526}$$

In the above formulas, M represents the mutual inductance between the exciting coil and the electroconductive layer.

As shown in (c) of FIG. 40, when a current passing through R1 is I1 and a current passing through R2 is I2, the following formula (527) holds.

$$j\omega M(I_1 - I_2) = (R_2 + j\omega(L_2 - M))I_2 \tag{527}$$

From the formula (527), the following formula (528) can be derived. (528)

$$I_1 = \frac{R_2 + j\omega L_2}{j\omega M} I_2$$

The efficiency (electric power conversion efficiency) is represented by (electric power consumption of resistance R2)/(electric power consumption of resistance R1)+(electric power consumption of resistance R2)), and therefore can be represented by the following formula (529).

$$\text{Power conversion efficiency} = \frac{R_2 \times |I_2^2|}{R_1 \times |I_1^2| + R_2 \times |I_2^2|} = \frac{\omega^2 M^2 R_2}{\omega^2 L_2^2 R_1 + R_1 R_2^2 + \omega^2 M^2 R_2} = \frac{Rx - R_1}{Rx} \tag{529}$$

When the series equivalent resistance R1 before the mounting of the electroconductive layer 1*a* and the series equivalent resistance Rx after the mounting of the electroconductive layer 1*a* are measured, the electric power conversion efficiency shows the degree of consumption of the electric power, in the electroconductive layer 1*a*, of the electric power supplied to the exciting coil 3. In this embodiment, for measurement of the electric power conversion efficiency, an impedance analyzer ("4294A", manufactured by Agilient Technologies) is used.

First, in a state in which there was no fixing sleeve 1, the series equivalent resistance R1 from the both ends of the winding was measured, and then in a state in which the magnetic core 2 was inserted into the fixing sleeve 1, the series equivalent resistance Rx from the both ends of the winding was measured. As a result, R1=103 milliohm and Rx=2.2Ω, so that the electric power conversion efficiency at this time can be obtained as 95.3% from the formula (529). Hereinafter, the performance of the fixing device will be evaluated using this electric power conversion efficiency.

Figure 41:
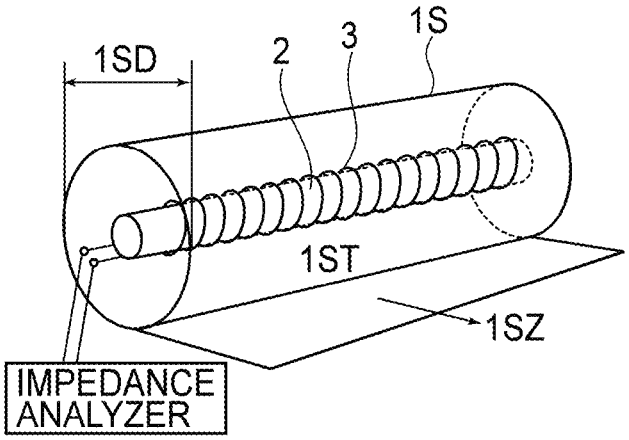
FIG. 41 is a schematic view showing an experimental device used in a measurement experiment for conversion efficiency of electric power.

Here, the electric power conversion efficiency necessary for the fixing device will be obtained. The electric power conversion efficiency is evaluated by changing the proportion of the magnetic flux passing through the outside route of the electroconductive layer 1*a*. FIG. 41 is a schematic view showing an experimental device used in a measurement test of the electric power conversion efficiency.

A metal sheet 1S is an aluminum-made sheet of 230 mm in width, 600 mm in length and 20 μm in thickness. This metal sheet 1S is rolled up in a cylindrical shape so as to enclose the magnetic core 2 and the coil 3, and is electrically conducted at a portion 1ST to prepare an electroconductive layer.

The magnetic core 2 is ferrite of 1800 in relative permeability and 500 mT in saturation flux density, and has a cylindrical shape of 26 $mm^2$ in cross-sectional area and 230 mm in length. The magnetic core 2 is disposed substantially at a central (axis) portion of the cylinder of the aluminum sheet 1S by an unshown fixing means. Around the magnetic core 2, the exciting coil 3 is helically wound 25 times in winding number.

When an end portion of the metal sheet 1S is pulled in an arrow 1SZ direction, the diameter 1SD of the electroconductive layer can be adjusted in a range of 18 mm to 191 mm.

Figure 42:
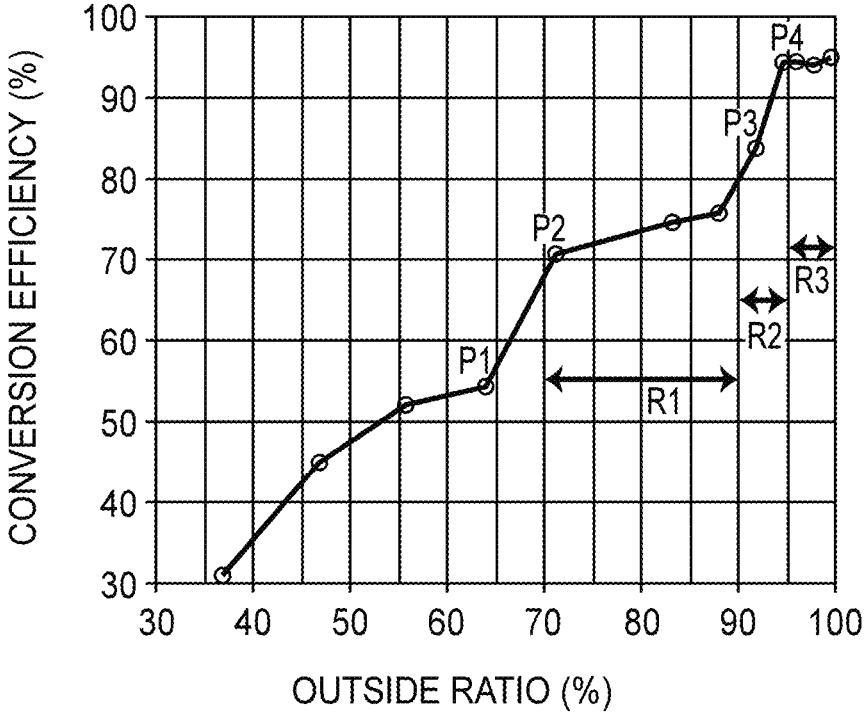
FIG. 42 is a graph showing a relationship between an outside ratio and the conversion efficiency of the electric power.

FIG. 42 is a graph in which the abscissa represents a ratio (%) of the magnetic flux passing through the outside route of the electro conductive layer, and the ordinate represents the electric power conversion efficiency (%) at a frequency of 21 kHz. In the graph of FIG. 42, the electric power conversion efficiency abruptly increases from a point P1 and then exceeds 70%, and is maintained at 70% or more in a range R1 indicated by a double-pointed arrow. In the neighborhood of P3, the electric power conversion efficiency abruptly increases again and exceeds 80% in a range R2. In a range R3 from P4, the electric power conversion efficiency is stable at a high value of 94% or more. The reason why the electric power conversion efficiency abruptly increases is that the control direction current starts to pass through the electroconductive layer efficiently.

Table 2 below shows a result of evaluation of constitutions, corresponding to P1 to P4 in FIG. 42, actually designed as fixing devices.

TABLE 2

| Plot | Range | D*1 (m) | P*2 (%) | CE*3 (%) | ER*4 |
|---|---|---|---|---|---|
| P1 | — | 143.2 | 64.0 | 54.4 | IEP*5 |
| P2 | R1 | 127.3 | 71.2 | 70.8 | CM*6 |
| P3 | R2 | 63.7 | 91.7 | 83.9 | HRD*7 |
| P4 | R3 | 47.7 | 94.7 | 94.7 | OPTIMUM*8 |

*1"D" represents the electroconductive layer diameter.
*2"P" represents the proportion of the magnetic flux passing through the outside route of the electroconductive layer.
*3"CE" represents the electric power conversion efficiency.
*4"ER" represents an evaluation result in the case where the fixing device has a high specification.
*5"IEP" is that there is a possibility that the electric power becomes insufficient.
*6"CM" is that it is desirable that a cooling means is provided.
*7"HRD" is that it is desirable that heat-resistant design is optimized.
*8"OPTIMUM" is that the constitution is optimum for the flexible film.

(Fixing Device P1)

In this constitution, the cross-sectional area of the magnetic core is 26.5 $mm^2$ (5.75 mm×4.5 mm), the diameter of the electroconductive layer is 143.2 mm, and the proportion of the magnetic flux passing through the outside route is 64%. The electric power conversion efficiency of this device, obtained by the impedance analyzer was 54.4%. The electric power conversion efficiency is a parameter indicating the degree (proportion) of electric power contributing to heat generation of the electroconductive layer, of the electric power supplied to the fixing device. Accordingly, even when the constitution is designed as the fixing device capable of outputting a maximum of 1000 W, about 450 W is loss, and this loss results in heat generation of the coil and the magnetic core.

In the case of this constitution, during rising, the coil temperature exceeds 200° C. in some cases, even when 1000 W is supplied only for several seconds. When there is a loss of 45% and the heat-resistant temperature of an insulating member of the coils is a high 200° C. and the Curie point of the ferrite magnetic core is about 200° C. to about 250° C., it becomes difficult to maintain a member such as the exciting coil at the heat-resistant temperature or less. Further, when the temperature of the magnetic core exceeds the Curie point, the coil inductance abruptly decreases, so that the load fluctuates.

About 45% of the electric power supplied to the fixing device is not used for heat generation of the electroconductive layer, and therefore in order to supply an electric power of 900 W (estimated as 90% of 1000 W) to the electroconductive layer, there is a need to supply electric power of about 1636 W. This means that a power source is such that 16.3 A is consumed when 100 V is inputted. Therefore, there is a possibility that the consumed current exceeds the allowable current capable of being supplied from an attachment plug of a commercial AC power source. Accordingly, in the fixing device P1 whose electric power conversion efficiency is 54.4%, there is a possibility that the electric power to be supplied to the fixing device is insufficient.

(Fixing Device P2)

In this constitution, the cross-sectional area of the magnetic core is the same as the cross-sectional area in P1, the diameter of the electroconductive layer is 127.3 mm, and the proportion of the magnetic flux passing through the outside route is 71.2%. The electric power conversion efficiency, of this device, obtained by the impedance analyzer was 70.8%. In some cases, the temperature rise of the coil and the core becomes problematic, depending on the specific construction and operation of the fixing device.

When the fixing device of this constitution is constituted as a device having a high performance specification, such as the ability to print (a printing operation) 60 sheets/min, the rotational speed of the electroconductive layer is 330 mm/sec, so that there is a need to maintain the temperature of the electroconductive layer at 180° C. When the temperature of the electroconductive layer is intended to be maintained at 180° C., the temperature of the magnetic core exceeds 240° C. in 20 sec in some cases. The Curie temperature (point) of ferrite used as the magnetic core is ordinarily about 200° C. to about 250° C., and therefore in some cases, the temperature of ferrite exceeds the Curie temperature and the permeability of the magnetic core abruptly decreases, and thus the magnetic lines of force cannot be properly induced by the magnetic core. As a result, it becomes difficult to induce the circumferential direction current to cause the electroconductive layer to generate heat in some cases.

Accordingly, when the fixing device, in which the proportion of the magnetic flux passing through the outside route is in the range R1, is constituted as the above-described high-specification device, in order to lower the temperature of the ferrite core, it is desirable that a cooling means is provided. As the cooling means, it is possible to use an air-cooling fan, water cooling, a cooling wheel, a radiation fin, a heat pipe, a Peltier element or the like. In this constitution, there is no need to provide the cooling means in the case where the high specification is not required to such extent.

(Fixing Device P3)

This constitution is the case where the cross-sectional area of the magnetic core is the same as the cross-sectional area in P1, and the diameter of the electroconductive layer is 63.7 mm. The electric power conversion efficiency of this device, obtained by the impedance analyzer, was 83.9%. Although the heat quantity is steadily-generated in the magnetic core, the coil and the like, the level thereof is not a level that requires a cooling means.

When the fixing device of this constitution is constituted as a device having a high performance specification, such as the ability to print (printing operation) 60 sheets/min, the rotational speed of the electroconductive layer is 330 mm/sec, so that there is a need to maintain the surface temperature of the electroconductive layer at 180° C., but the temperature of the magnetic core (ferrite) does not increase to 220° C. or more. Accordingly, in this constitution, in the case where the fixing device is constituted as the above-described high-specification device, it is desirable that ferrite having the Curie temperature of 220° C. or more is used.

As described above, in the case where the fixing device, in which the proportion of the magnetic flux passing through the outside route is in the range R2, is used as the high-performance-specification device, it is desirable that heat-resistant design of ferrite or the like is optimized. On the other hand, in the case where the high performance specification is not required as the fixing device, such heat-resistant design is not needed.

(Fixing Device P4)

This constitution is the case where the cross-sectional area of the magnetic core is the same as the cross-sectional area in P1, and the diameter of the electroconductive layer is 47.7 mm. The electric power conversion efficiency, of this device, obtained by the impedance analyzer was 94.7%.

When the fixing device of this constitution is constituted as a device having a high performance specification such as the ability to print (printing operation) 60 sheets/min, (rotational speed of electroconductive layer: 330 mm/sec), even in the case where the surface temperature of the electroconductive layer is maintained at 180° C., the temperatures of the exciting coil, the magnetic core, and the like do not reach 180° C. or more. Accordingly, the cooling means for cooling the magnetic core, the coil and the like, and particular heat-resistant design are not needed.

As described above, in the range R3 in which the proportion of the magnetic flux passing through the outside route is 94.7% or more, the electric power conversion efficiency is 94.7% or more, and thus is sufficiently high. Therefore, even when the fixing device of this constitution is used as a further high-performance-specification fixing device, the cooling means is not needed.

Further, in the range R3 in which the electric power conversion efficiency is stable at high values, even when the amount of the magnetic flux, per unit time, passing through the inside of the electroconductive layer somewhat fluctuates depending on a fluctuation in positional relationship between the electroconductive layer (heat generating layer) and the magnetic core, the fluctuation amount of the electric power conversion efficiency is small, and therefore the heat generation amount of the electroconductive layer is stabilized. As in the case of the sleeve, in the fixing device in which the distance between the electroconductive layer and the magnetic core is liable to fluctuate, use of the range R3 in which the electric power conversion efficiency is stable at the high values has a significant advantage.

As described above, it is desirable that in the fixing device in this embodiment, the proportion of the magnetic flux passing through the outside route is 72% or more in order to satisfy at least the necessary electric power conversion. In Table 2, in the fixing device in this embodiment, the proportion of the magnetic flux passing through the outside route is 71.2% in the range R1, but in view of a measurement error or the like, the magnetic flux proportion is required to be 72% or more.

2-5) Relational Expression of Permeance or Magnetic Reluctance to be Satisfied by Fixing Device The requirement that the proportion of the magnetic flux passing through the outside route of the electroconductive layer is 72% or more is equivalent to the requirement that the sum of the permeance of the electroconductive layer and the permeance of the induction (region between the electroconductive layer and the magnetic core) of the electroconductive layer is 28% or less of the permeance of the magnetic core.

Accordingly, one of features of the constitution in this embodiment is that when the permeance of the magnetic core is Pc, the permeance of the inside of the electroconductive layer is Pa, and the permeance of the electroconductive layer is Ps, the following formula (529a) is satisfied.

$$0.28\times Pc\div Ps+Pa \tag{529a}$$

When the relational expression of the permeance is replaced with a relational expression of the magnetic reluctance, the following formula (530) is satisfied.

$$0.28\times P_C \geq P_s + P_a \tag{530}$$

$$0.28\times \frac{1}{Rc} \geq \frac{1}{R_s} + \frac{1}{R_a}$$

$$0.28\times \frac{1}{Rc} \geq \frac{1}{R_{sa}}$$

$$0.28\times R_{sa} \geq Rc$$

However, a combined magnetic reluctance Rsa of Rs and Ra is calculated by the following formula (531).

$$\frac{1}{R_{sa}} = \frac{1}{R_s} + \frac{1}{R_a} \tag{531}$$

$$R_{sa} = \frac{R_a \times R_s}{R_a + R_s}$$

Rc: magnetic reluctance of the magnetic core

Rs: magnetic reluctance of the electroconductive layer

Ra: magnetic reluctance of the region between the electroconductive layer and the magnetic core Rsa: combined magnetic reluctance of Rs and Ra The above-described relational expression of the permeance or the magnetic reluctance may desirably be satisfied, in a cross-section perpendicular to the generatrix direction of the sleeve, over a whole of a maximum recording material reading region of the fixing device.

Similarly, in the fixing device in this embodiment, the proportion of the magnetic flux passing through the outside route is 92% or more in the range R2.

In Table 2, in the fixing device in this embodiment, the proportion of the magnetic flux passing through the outside route is 91.7% in the range R2, but in view of a measurement error or the like, the magnetic flux proportion is 92%. The requirement that the proportion of the magnetic flux passing through the outside route of the electroconductive layer is 92% or more is equivalent to the requirement that the sum of the permeance of the electroconductive layer and the permeance of the induction (region between the electroconductive layer and the magnetic core) of the electroconductive layer is 8% or less of the permeance of the magnetic core.

Accordingly, the relational expression of the permeance is represented by the following formula (532).

$$0.08\times Pc\geq Ps+Pa \tag{532}$$

When the relational expression of the permeance is converted into a relational expression of the magnetic reluctance, the following formula (533) is satisfied.

$$0.08\times P_c\geq P_s+P_a$$

$$0.08\times R_{sa}\geq R_c \tag{533}$$

Further, in the fixing device in this embodiment, the proportion of the magnetic flux passing through the outside route is 95% or more in the range R3. In Table 2, in the fixing device in this embodiment, the proportion of the magnetic flux passing through the outside route is 94.7% in the range R3, but in view of a measurement error or the like, the magnetic flux proportion is 95%. The requirement that the proportion of the magnetic flux passing through the outside route of the electroconductive layer is 95% or more is equivalent to the requirement that the sum of the permeance of the electroconductive layer and the permeance of the induction (region between the electroconductive layer and the magnetic core) of the electroconductive layer is 5% or less of the permeance of the magnetic core.

Accordingly, the relational expression of the permeance is represented by the following formula (534).

$$0.05\times Pc\geq Ps+Pa \tag{534}$$

When the relational expression of the permeance is converted into a relational expression of the magnetic reluctance, the following formula (535) is satisfied.

$$0.05\times P_c\geq P_s+P_a$$

$$0.05\times R_{sa}\geq R_c \tag{635}$$

Figure 43:
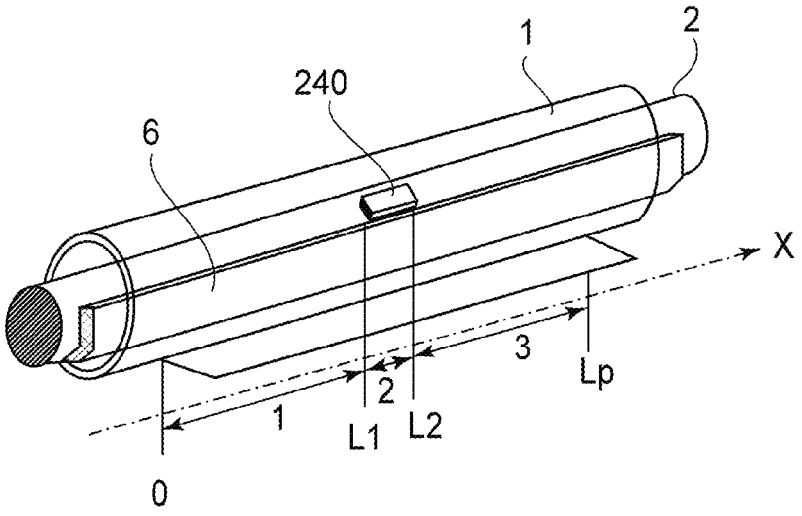
FIG. 43 is a schematic view showing a positional relationship among a sleeve, a magnetic core, a nip forming member and a temperature detecting member of the fixing device.

In the above, the relational expressions of the permeance and the magnetic reluctance in the fixing device in which the member or the like in the maximum image region of the fixing device has a uniform cross-sectional structure were shown. In the following, the fixing device in which the member or the like constituting the fixing device has a non-uniform cross-sectional structure with respect to the longitudinal direction will be described with reference to FIG. 43. FIG. 43 is a schematic view showing the positional relationship among the sleeve 1, the magnetic core 2, the nip forming member 6, and the temperature detecting member 240.

The fixing device shown in FIG. 43 includes the temperature detecting member 240 is provided inside (region between the magnetic core and the electroconductive layer) of the electroconductive layer 1*a*. Other constitutions are the same as those in the above embodiment, so that the fixing device includes the sleeve 1 including the electroconductive layer 1*a*, and includes the magnetic core 2 and the nip forming member (thermistor 6).

When the longitudinal direction of the magnetic core 2 is an X-axis direction, the maximum image forming region is a range from 0 to Lp on the X-axis. For example, in the case of the image forming apparatus in which the maximum recording material feeding region is the LTR size of 215.9 mm, Lp is 215.9 mm may only be satisfied.

The temperature detecting member 240 is constituted by a non-magnetic material of 1 in relative permeability, and is 5 mm×5 mm in cross-sectional area with respect to a direction perpendicular to the X-axis and 10 mm in length with respect to a direction parallel to the X-axis. The temperature detecting member 240 is disposed at position from L1 (102.95 mm) to L2 (112.95 mm) on the X-axis.

Figure 44:
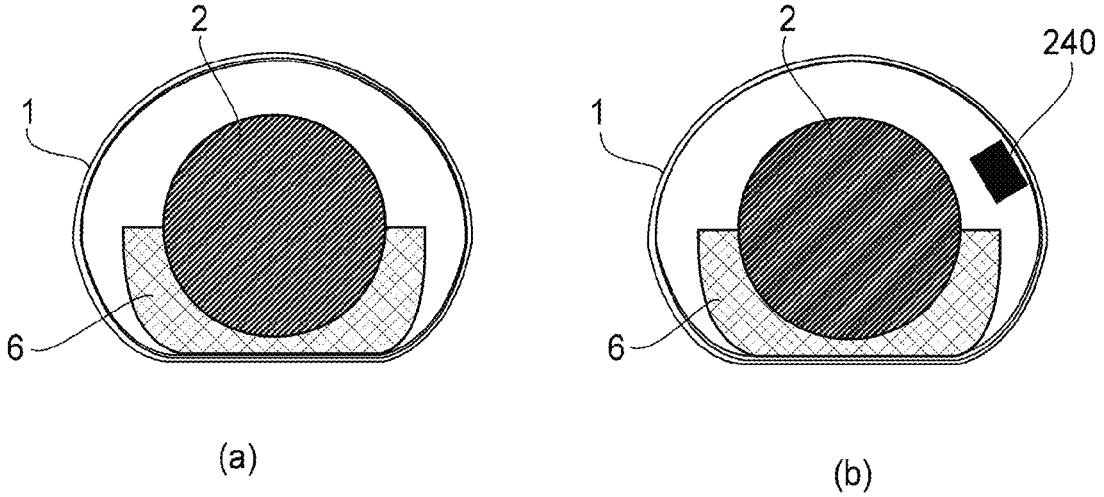
In FIG. 44, (a) and (b) are schematic views each showing a cross-sectional structure of the fixing device shown in FIG. 43.

Here, on the X-axis, a region from 0 to L1 is referred to as region 1, a region from L1 to L2 where the temperature detecting member 240 exists is referred to as region 2, and a region from L2 to Lp is referred to as region 3. The cross-sectional structure in the region 1 is shown in (a) of FIG. 44, and the cross-sectional structure in the region 2 is shown in (b) of FIG. 44. As shown in (b) of FIG. 44, the temperature detecting member 240 is incorporated in the sleeve 1, and therefore is an object to be subjected to calculation of the magnetic reluctance. In order to strictly make the magnetic reluctance calculation, the "magnetic reluctance per unit length" in each of the regions 1, 2 and 3 is obtained separately, and an integration calculation is made depending on the length of each region, and then the combined magnetic reluctance is obtained by adding up the integral values.

First, the magnetic reluctance per unit length of each of components (parts) in the region 1 or 3 is shown in Table 3.

TABLE 3

| Item | U*1 | MC*2 | SG*3 | IEL*4 | EL*5 |
|---|---|---|---|---|---|
| CSA*6 | $m^2$ | 1.5E−04 | 1.0E−04 | 2.0E−04 | 1.5E−06 |
| RP*7 | | 1800 | 1 | 1 | 1 |

TABLE 3-continued

| Item | U*1 | MC*2 | SG*3 | IEL*4 | EL*5 |
|---|---|---|---|---|---|
| P*8 | H/m | 2.3E−03 | 1.3E−06 | 1.3E−06 | 1.3E−06 |
| PUL*9 | H · m | 3.5E−07 | 1.3E−10 | 2.5E−10 | 1.9E−12 |
| MRUL*10 | 1/(H · m) | 2.9E+06 | 8.0E+09 | 4.0E+09 | 5.3E+11 |

*1"U" is the unit.
*2"MC" is the magnetic core.
*3"SG" is the sleeve guide.
*4"IEL" is the inside of the electroconductive layer.
*5"EL" is the electroconductive layer.
*6"CSA" is the cross-sectional area.
*7"RP" is the relative permeability.
*8"P" is the permeability.
*9"PUL" is the permeance per unit length.
*10"MRUL" is the magnetic reluctance per unit length.

In the region 1, a magnetic reluctance per unit length (rc1) of the magnetic core is as follows.

$$rc1=2.9\times10^{6}\ (1/(H\cdot m))$$

In the region between the electroconductive layer and the magnetic core, a magnetic reluctance per unit length ($r_a$) is a combined magnetic reluctance of a magnetic reluctance per unit length ($r_f$) of the nip forming member and a magnetic reluctance per unit length ($r_{air}$) of the inside of the electroconductive layer. Accordingly, the magnetic reluctance $r_a$ can be calculated using the following formula (536).

$$\frac{1}{r_a}=\frac{1}{r_f}+\frac{1}{r_{air}} \tag{536}$$

As a result of the calculation, a magnetic reluctance $r_{a1}$ in the region 1 and a magnetic reluctance $r_{s1}$ in the region 1 are follows.

$$r_{a1}=2.7\times10^{9}\ (1/(H\cdot m))$$

$$r_{s1}=5.3\times10^{11}\ (1/(H\cdot m))$$

Further, the region 3 is equal in length to the region 1, and therefore magnetic reluctance values in the region 3 are as follows.

$$r_{c3}=2.9\times10^{6}\ (1/(H\cdot m))$$

$$r_{a3}=2.7\times10^{9}\ (1/(H\cdot m))$$

$$r_{s3}=5.3\times10^{11}\ (1/(H\cdot m))$$

Next, the magnetic reluctance per unit length of each of components (parts) in the region 2 is shown in Table 4.

TABLE 4

| Item | U*1 | MC*2 | SG*3 | T*4 | IEL*5 | EL*6 |
|---|---|---|---|---|---|---|
| CSA*7 | $m^2$ | 1.5E−04 | 1.0E−04 | 2.5E−05 | 1.72E−04 | 1.5E−06 |
| RP*8 | | 1800 | 1 | 1 | 1 | 1 |
| P*9 | H/m | 2.3E−03 | 1.3E−06 | 1.3E−06 | 1.3E−06 | 1.3E−06 |
| PUL*10 | H · m | 3.5E−07 | 1.3E−10 | 3.1E−11 | 2.2E−10 | 1.9E−12 |
| MRUL*11 | 1/(H · m) | 2.9E+06 | 8.0E+09 | 3.2E+10 | 4.6E+09 | 5.3E+11 |

*1"U" is the unit.
*2"MC" is the magnetic core.
*3"SG" is the sleeve guide.
*4"T" is the thermistor (temperature detecting member).
*6"EL" is the electroconductive layer.
*7"CSA" is the cross-sectional area.
*8"RP" is the relative permeability.
*9"P" is the permeability.
*10"PUL" is the permeance per unit length.
*11"MRUL" is the magnetic reluctance per unit length.

In the region 2, a magnetic reluctance per unit length (rc2) of the magnetic core is as follows.

$$rc2=2.9\times10^{6}\ (1/(H\cdot m))$$

In the region between the electroconductive layer and the magnetic core, a magnetic reluctance per unit length ($r_a$) is a combined magnetic reluctance of a magnetic reluctance per unit length ($r_f$) of the nip forming member, a magnetic reluctance per unit length ($r_t$) of the thermistor and a magnetic reluctance per unit length ($r_{air}$) of the inside air of the electroconductive layer. Accordingly, the magnetic reluctance $r_a$ can be calculated using the following formula (537).

$$\frac{1}{r_a}=\frac{1}{r_t}+\frac{1}{r_f}+\frac{1}{r_{air}} \tag{537}$$

As a result of the calculation, a magnetic reluctance per unit length ($r_{a2}$) in the region 1 and a magnetic reluctance per unit length ($r_{s2}$) in the region 2 are follows.

$$r_{a2}=2.7\times10^{9}\ (1/(H\cdot m))$$

$$r_{s2}=5.3\times10^{11}\ (1/(H\cdot m))$$

The region 3 is equal in calculating method to the region 1, and therefore the calculating method in the region 3 will be omitted.

The reason why $r_{a1}=r_{a2}=r_{a3}$ is satisfied with respect to the magnetic reluctance per unit length ($r_a$) of the region between the electroconductive layer and the magnetic core will be described. In the magnetic reluctance calculation in the region 2, the cross-sectional area of the thermistor 240 is increased, and the cross-sectional area of the inside air of the electroconductive layer is decreased. However, the relative permeability of both of the thermistor 240 and the electroconductive layer is 1, and therefore the magnetic reluctance is the same independently of the presence or absence of the thermistor 240 after all.

That is, in the case where only the non-magnetic material is disposed in the region between the electroconductive layer and the magnetic core, calculation accuracy is sufficient even when the calculation of the magnetic reluctance is similarly treated as in the case of the inside air. This is because in the case of the non-magnetic material, the relative permeability becomes a value almost close to 1. On the other hand, in the case of the magnetic material (such as nickel, iron or silicon steel), the magnetic reluctance in the region where the magnetic material exists may preferably be calculated separately from the material in another region.

Integration of magnetic reluctance R (A/Wb(1/h)) as the combined magnetic reluctance with respect to the generatrix direction of the electroconductive layer can be calculated using magnetic reluctance values r1, r2 and r3 (1/(H·m)) in the respective regions as shown in the following formula (538).

$$R = \int_0^{L1} r1dl1 + \int_{L1}^{L2} r2dl1 + \int_{L2}^{Lp} r3dl1 = r1(L1-0) + r2(L2-L1) + r3(LP-L2) \quad (538)$$

Accordingly, a magnetic reluctance Rc (H) of the core in a section from one end to the other end in the maximum recording material feeding region can be calculated as shown in the following formula (539).

$$R_c = \int_0^{L1} r_c1dl1 + \int_{L1}^{L2} r_c2dl1 + \int_{L2}^{Lp} r_c3dl1 = r_c1(L1-0) + r_c2(L2-L1) + r_c3(LP-L2) \quad (539)$$

Further, a combined magnetic reluctance Ra (H) of the region, between the electroconductive layer and the magnetic core, in the section from one end to the other end in the maximum recording material feeding region can be calculated as shown in the following formula (540).

$$R_a = \int_0^{L1} r_a1dl1 + \int_{L1}^{L2} r_a2dl1 + \int_{L2}^{Lp} r_a3dl1 = r_a1(L1-0) + r_a2(L2-L1) + r_a3(LP-L2) \quad (540)$$

Further, a combined magnetic reluctance Rs (H) of the electroconductive layer in the section from one end to the other end in the maximum recording material feeding region can be calculated as shown in the following formula (541).

$$R_s = \int_0^{L1} r_s1dl1 + \int_{L1}^{L2} r_s2dl1 + \int_{L2}^{Lp} r_s3dl1 = r_s1(L1-0) + r_s2(L2-L1) + r_s3(LP-L2) \quad (541)$$

A calculation result in each of the regions 1, 2 and 3 is shown in Table 5.

TABLE 5

| Item | Region 1 | Region 2 | Region 3 | MCR*1 |
|---|---|---|---|---|
| ISP*2 | 0 | 102.95 | 112.95 | |
| IEP*3 | 102.95 | 112.95 | 215.9 | |
| D*4 | 102.95 | 10 | 102.95 | |
| pc*5 | 3.5E−07 | 3.5E−07 | 3.5E−07 | |
| rc*6 | 2.9E+06 | 2.9E+06 | 2.9E+06 | |
| Irc*7 | 3.0E+08 | 2.9E+07 | 3.0E+08 | 6.2E+08 |
| pm*8 | 3.7E−10 | 3.7E−10 | 3.7E−10 | |
| rm*9 | 2.7E+09 | 2.7E+09 | 2.7E+09 | |
| Irm*10 | 2.8E+11 | 2.7E+10 | 2.8E+11 | 5.8E+11 |
| ps*11 | 1.9E−12 | 1.9E−12 | 1.9E−12 | |
| rs*12 | 5.3E+11 | 5.3E+11 | 5.3E+11 | |
| Irs*13 | 5.4E+13 | 5.3E+12 | 5.4E+13 | 1.1E+14 |

*1"CMR" is the combined magnetic reluctance.
*2"ISP" is an integration start point (mm).
*3"IEP" is an integration end point (mm).
*4"D" is the distance (mm).
*5"pc" is the permeance per unit length (H · m).
*6"rc" is the magnetic reluctance per unit length (1/(H · m)).
*7"Irc" is integration of the magnetic reluctance rm (A/Wb(1/H)).
*8"pm" is the permeance per unit length (H · m).
*9"rm" is the magnetic reluctance per unit length (1/(Hfai · m)).
*10"Irm" is integration of the magnetic reluctance rm (A/Wb(1/H)).
*11"ps" is the permeance per unit length (H · m).
*12"rs" is the magnetic reluctance per unit length (1/(H · m)).
*13"Irs" is integration of the magnetic reluctance rm (A/Wb(1/H)).

From Table 5, Rc, Ra and Rs are follows.

$$Rc = 6.2\times10^{8}\ (1/H)$$

$$Ra = 5.8\times10^{11}\ (1/H)$$

$$Rs = 1.1\times10^{14}\ (1/H)$$

The combined magnetic reluctance Rsa of Rs and Ra can be calculated by the following formula (542).

$$\frac{1}{R_{sa}} = \frac{1}{R_s} + \frac{1}{R_a} \quad (542)$$

$$R_{sa} = \frac{R_a \times R_s}{R_a + R_s}$$

From the above calculation, Rsa=5.8×10$^{11}$ (1/h) holds, thus satisfying the following formula (543).

$$0.28\times R_{sa} \geq R_c \quad (543)$$

As described above, in the case of the fixing device in which a non-uniform cross-sectional shape is formed with respect to the generatrix direction of the electroconductive layer, the region is divided into a plurality of regions, and the magnetic reluctance is calculated for each of the divided regions, and finally, the combined permeance or magnetic reluctance may be calculated from the respective magnetic reluctance values. However, in the case where the member to be subjected to the calculation is the non-magnetic material, the permeability is substantially equal to the permeability of the air, and therefore the calculation may be made by regarding the member as the air.

Next, the component (part) to be included in the above calculation will be described. With respect to the component which is disposed between the electroconductive layer and the magnetic core and at least a part of which is placed in the maximum recording material feeding region (0 to Lp), it is desirable that the permeance or the magnetic reluctance thereof is calculated.

On the other hand, with respect to the component (member) disposed outside the electroconductive layer, there is no need to calculate the permeance or the magnetic reluctance thereof. This is because as described above, in the Faraday's law, the induced electromotive force is proportional to a change with time of the magnetic flux vertically passing through the circuit, and therefore is independent of the magnetic flux outside the electroconductive layer. Further, with respect to the member disposed out of the maximum recording material feeding region with respect to the generatrix direction of the electro conductive layer, the component has no influence on the heat generation of the electroconductive layer, and therefore there is no need to make the calculation.

3. Printer Control

In FIG. 2, temperature sensing elements 9, 10 and 11 as the temperature detecting member are provided. These temperature sensing elements 9, 10 and 11 are non-contact thermistors and are disposed so as to oppose the surface of the sleeve 1 in an upstream side of the fixing device A with respect to the feeding direction a of the recording material P. Further, the temperature sensing elements 9, 10 and 11 are disposed inside an image forming region ("IFR" in FIG. 3), through which a large-sized recording material passes, with respect to the longitudinal direction of the sleeve 1.

The temperature sensing element 9 disposed at the longitudinal central portion of the sleeve 1 can detect the sleeve surface temperature in a passing region ("PR" in FIG. 3) through which a small-sized recording material and the large-sized recording material always pass in the image forming region of the sleeve 1. The temperature sensing elements 10 and 11 disposed at one and the other longitudinal end portions, respectively, of the sleeve 1 can detect the sleeve surface temperature in a non-passing region ("NPR" in FIG. 3) through which the small-sized recording material does not pass in the image forming region of the sleeve 1.

In FIG. 4, in a printer control portion 40, a printer controller 41 effects communication and image data reception between itself and a host computer 42, and develops the image data into printable information. Further, the printer controller 41 effects transmission and reception of signals and signal communication between itself and an engine controller 43 as a controller.

The engine controller 43 effects transmission and reception of signals between itself and the printer controller 41, and controls a fixing temperature controller 44, a frequency controller 45 and an electric power controller 46 via the serial communication.

The fixing temperature controller 44 as a temperature adjusting means not only controls the temperature of the surface of the sleeve 1 on the basis of temperatures detected by the temperature sensing elements 9, 10 and 11, but also detects an abnormality of the surface temperature of the sleeve 1. The frequency controller 45 as a drive frequency setting means effects control of a drive frequency of the high-frequency converter 16. The electric power controller 46 effects control of the electric power supplied to the high-frequency converter 16 in order to adjust a voltage to be applied to the exciting coil 3.

In a printer system including such a printer control portion 40, the host computer 42 transfers the image data to the printer controller 41, and sets various printing conditions, such as a recording material size, in the printer controller 41 depending on a demand from a user. The printer system includes the image forming apparatus 100 and the host computer 42 which is capable of communicating with the image forming apparatus 100.

4. Heat-Fixing Operation of the Fixing Device A

In the fixing device A in this embodiment, the pressing roller 8 is rotated in the arrow direction by the motor in accordance with a print instruction (FIG. 2). The sleeve 1 is rotated in the arrow direction by the rotation of the pressing roller 8 while contacting the flat surface 6*a* of the nip forming member 6 at the inner surface thereof. The electric power controller 46 actuates a high-frequency converter 16 in accordance with the print instruction, and the high-frequency converter 16 supplies a high-frequency current to the exciting coil 3 via the energization contact portions 3*a* and 3*b*. As a result, the heat generating layer 1*a* of the sleeve 1 generates heat through electromagnetic induction heating, and thus the sleeve 1 quickly increases in temperature.

Detection temperatures of the temperature sensing elements 9, 10 and 11 for monitoring the surface temperature of the sleeve 1 are obtained by the fixing temperature controller 44. The fixing temperature controller 44 controls the electric power controller 46 and the frequency controller 45 through the engine controller 43 on the basis of the detection temperature. As a result, the surface temperature of the sleeve 1 is maintained and adjusted at a predetermined temperature control temperature (target temperature).

The recording material P carrying thereon the (unfixed) toner image T is nipped and fed through the nip N while heat and nip pressure are applied to the sleeve 1, so that the toner image is heat-fixed on the recording material P.

(5) Heat Generation Principle

Figure 6:
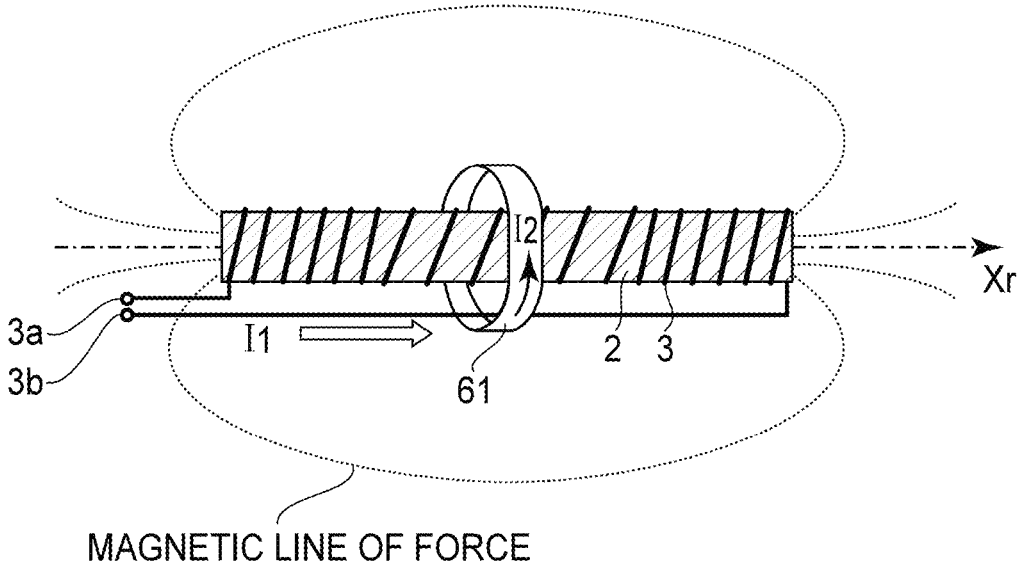
FIG. 6 is a schematic view showing a magnetic field in the case where a current flows into the exciting coil in an arrow direction.
Figure 7:
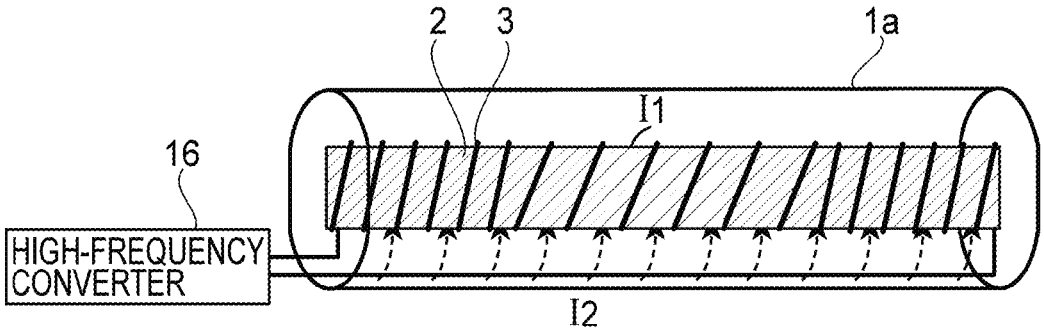
FIG. 7 is a schematic view showing a circumferential direction current flowing into a heat generating layer.
Figure 8:
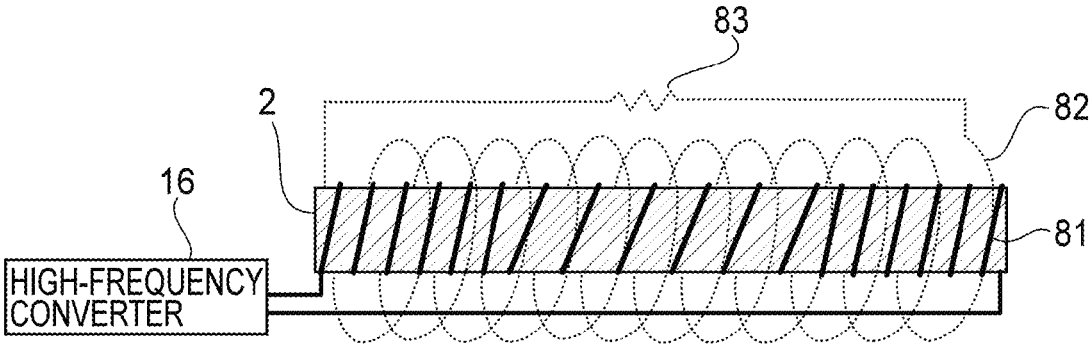
FIG. 8 is a schematic view showing a magnetic coupling of a coaxial transformer having a shape permitting winding of a primary coil and a secondary coil.

FIG. 6 is a schematic view sharing a magnetic field at the instant when the current increases in an arrow I1 direction in the exciting coil 3. FIG. 7 is a schematic view showing a circumferential current flowing into the heat generating layer 1*a*. FIG. 8 is a schematic view showing magnetic coupling of a coaxial transformer having a shape such that a primary coil and a secondary coil are wound.

In FIG. 6, the magnetic core 2 functions as a member for inducing the magnetic lines of force generated in the exciting coil 3 into the inside thereof to form a magnetic path. For that reason, the magnetic lines of force have a shape such that the magnetic lines of force concentratedly pass through the magnetic path and diffuse at the end portion of the magnetic core 2, and then are connected at portions far away from the outer peripheral surface of the magnetic core 2. In FIG. 6, such a connection state of the magnetic lines of force is partly omitted. A cylindrical circuit 61 having a small longitudinal width was provided so as to vertically surround this magnetic path. Inside the magnetic core 2, there is an AC magnetic field (in which the magnitude and the direction of the magnetic field repeatedly change thereof with time).

With respect to a circumferential direction of this circuit 61, the induced electromotive force is generated in accordance with the Faraday's law. The Faraday's law is such that the magnitude of the induced electromotive force generated in the circuit 61 is proportional to a ratio of a change in magnetic field penetrating through the circuit 61, and the induced electromotive force is represented by the following formula (1).

$$V = -N\frac{\Delta\Phi}{\Delta t} \tag{1}$$

V: inducted electromotive force

N: the number of winding of coil $\Delta\phi/\Delta t$: change in magnetic flux vertically penetrating through the circuit in a minute time $\Delta t$ It can be considered that the heat generating layer 1*a* is formed by connecting many short cylindrical circuits 61 with respect to the longitudinal direction. Accordingly, the heat generating layer 1*a* can be formed as shown in FIG. 7. When the current is passed through the exciting coil 3 in the arrow I1 direction, the AC magnetic field is formed inside the magnetic core 2, and the induced electromotive force is exerted over the entire longitudinal region of the heat generating layer 1*a* with respect to the circumferential direction, so that a circumferential direction current I2 indicated by broken lines flows over the entire longitudinal region.

The heat generating layer 1*a* has an electric resistance, and therefore the Joule heat is generated by a flow of this circumferential direction current I2. As long as the AC magnetic field is continuously formed inside the magnetic core 2, the circumferential direction current I2 is continuously formed while changing direction thereof. This is the heat generation principle of the heat generating layer 1*a* in the constitution of the present invention. For example, in the case where the current I1 is a high-frequency AC current of 50 kHz in frequency, the circumferential direction current I2 is also a high-frequency AC current of 50 kHz in frequency.

As described above with reference to FIG. 7, I1 represents the direction of the current flowing into the exciting coil 3, and the induced current flows in the arrow I2 direction, which is a direction of canceling the AC magnetic field formed by the current I1, indicated by the broken lines in the entire circumferential region of the heat generating layer 1*a*. A physical model in which the current I2 is induced is, as shown in FIG. 8, equivalent to the magnetic coupling of the coaxial transformer having a shape in which a primary coil 81 indicated by a solid line and a secondary coil 82 indicated by a dotted line.

In FIG. 8, the secondary winding 82 constituting the secondary coil forms a circuit in which a resistor 83 is included. By the AC voltage generated from the high-frequency converter 16, the high-frequency current is generated in the primary winding 81 constituting the primary coil, with the result that the induced electromotive force is exerted on the secondary winding 82, and thus is consumed as heat by the resistor 83. The Joule heat generated in the heat generating layer 1*a* is modeled as the secondary winding 82 and the resistor 83.

Figure 9:
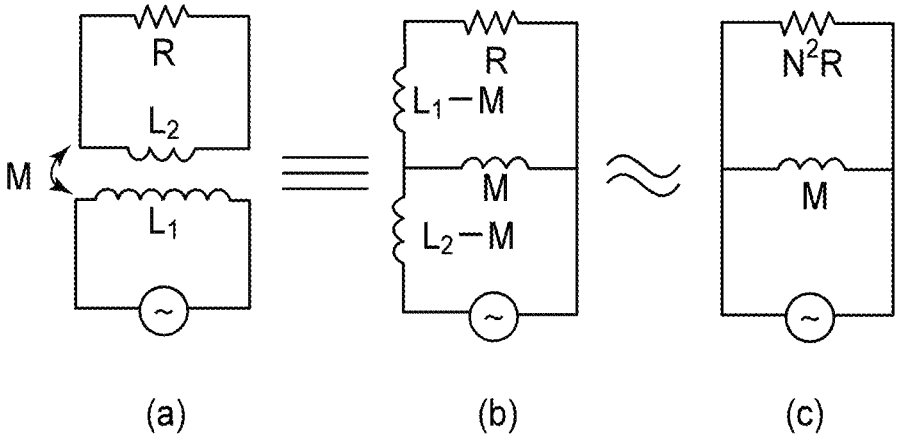
FIG. 9 is a schematic view showing an equivalent circuit of the magnetic coupling shown in FIG. 8.

An equivalent circuit of the model view shown in FIG. 8 is shown in (a) of FIG. 9. In (a) of FIG. 9, L1 is an inductance of the primary winding 81 in FIG. 8, L2 is an inductance of the secondary winding 82 in FIG. 8, M is a mutual inductance between the primary winding 81 and the secondary winding 82, and R is the resistor 83.

The equivalent circuit shown in (a) of FIG. 9 can be equivalently converted into an equivalent circuit shown in (b) of FIG. 9. In order to consider a further simplified model, the case where the mutual inductance M is sufficiently large and L1, L2 and M are nearly equal to each other is assumed. In that case, (L1-M) and (L2-M) are sufficiently small, and therefore the circuit of (b) of FIG. 9 can be approximated to an equivalent circuit shown in (c) of FIG. 9. As described above, the constitution in this embodiment shown in FIG. 7 will be considered as a replaced constitution represented by the approximated equivalent circuit shown in (c) of FIG. 9. First, the resistance will be described.

In a state of (a) of FIG. 9, an impedance in the secondary side is the electric resistance R with respect to the circumferential direction of the heat generating layer 1*a*. In the transformer, the impedance in the secondary side is an equivalent resistance R' which is $N^2$ times (N: a winding number ratio of the transformer) that in the primary side. Here, the winding number ratio N can be considered as N=18 by regarding the winding number for the heat generating layer 1*a* as one with respect to the winding number (18 in this embodiment) of the exciting coil 3 per the winding number of the winding in the primary side (heat generating layer 1*a*). Therefore, it can be considered that $R'=N^2R=18^2R$ holds, so that the equivalent resistance R shown in (c) of FIG. 9 becomes larger with a larger winding number.

Figure 10:
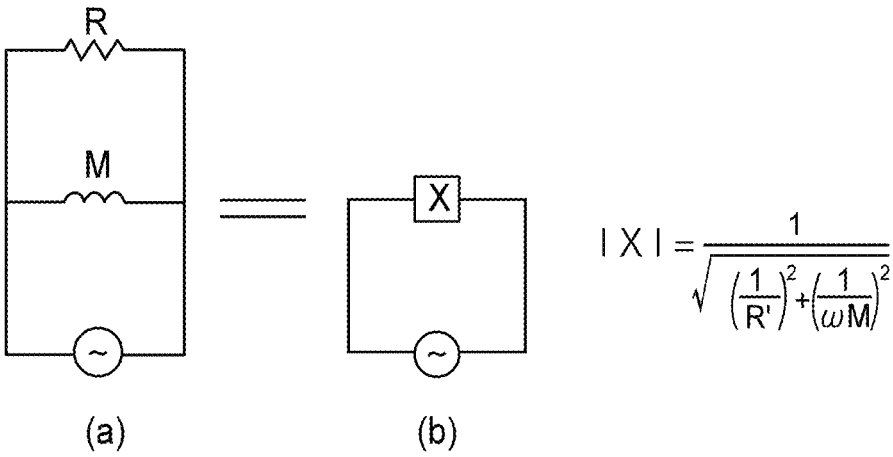
FIG. 10 is a schematic view showing an equivalent circuit obtained by simplifying the equivalent circuit shown in FIG. 9.

In (b) of FIG. 10, a synthetic impedance X is defined, and the above equivalent circuit is further simplified. The synthetic impedance X is represented by the following formula (2).

$$\frac{1}{X} = \frac{1}{R'} + \frac{1}{j\omega M}, \ (\omega = 2\pi f) \tag{2}$$

$$|X| = \frac{1}{\sqrt{\left(\frac{1}{R'}\right)^2 + \left(\frac{1}{\omega M}\right)^2}}$$

This simplified equivalent circuit will be used in explanation described later.

Figure 11:
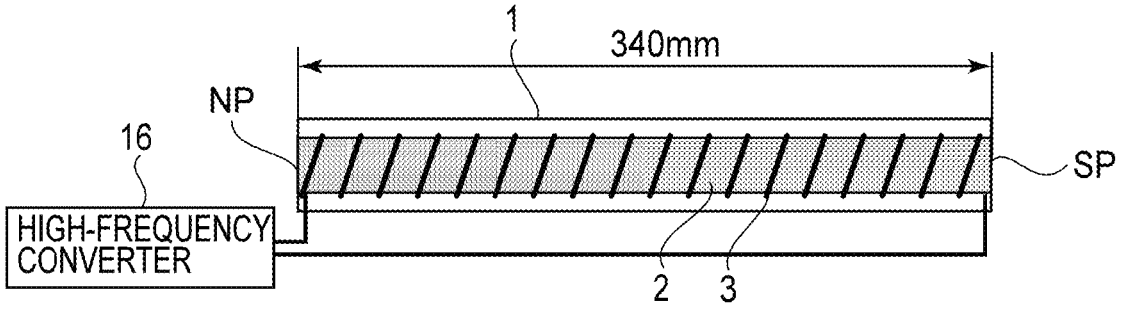
FIG. 11 is a schematic view showing a winding interval of the exciting coil.

(6) Reason Why Heat Generation amount Lowers in the Neighborhood of Magnetic Core End Portions The problem that the heat generation amount decreases in the neighborhood of the magnetic core end portions, and thus a heat generation non-uniformity generated with respect to the longitudinal direction will be specifically described. FIG. 11 is a schematic view showing a winding interval of the exciting coil 3.

As shown in FIG. 11, the magnetic core 2 forms a rectilinear open magnetic path having magnetic poles NP and SP. The magnetic core 2 is 340 mm in longitudinal length. In this embodiment, the length of the magnetic core 2 is equal to the length of the sleeve 1. This is because downsizing of the fixing device A with respect to the longitudinal direction is realized by preventing the magnetic core 2 and the exciting coil 3 from protruding from the end portions of the sleeve 1.

Figure 12:
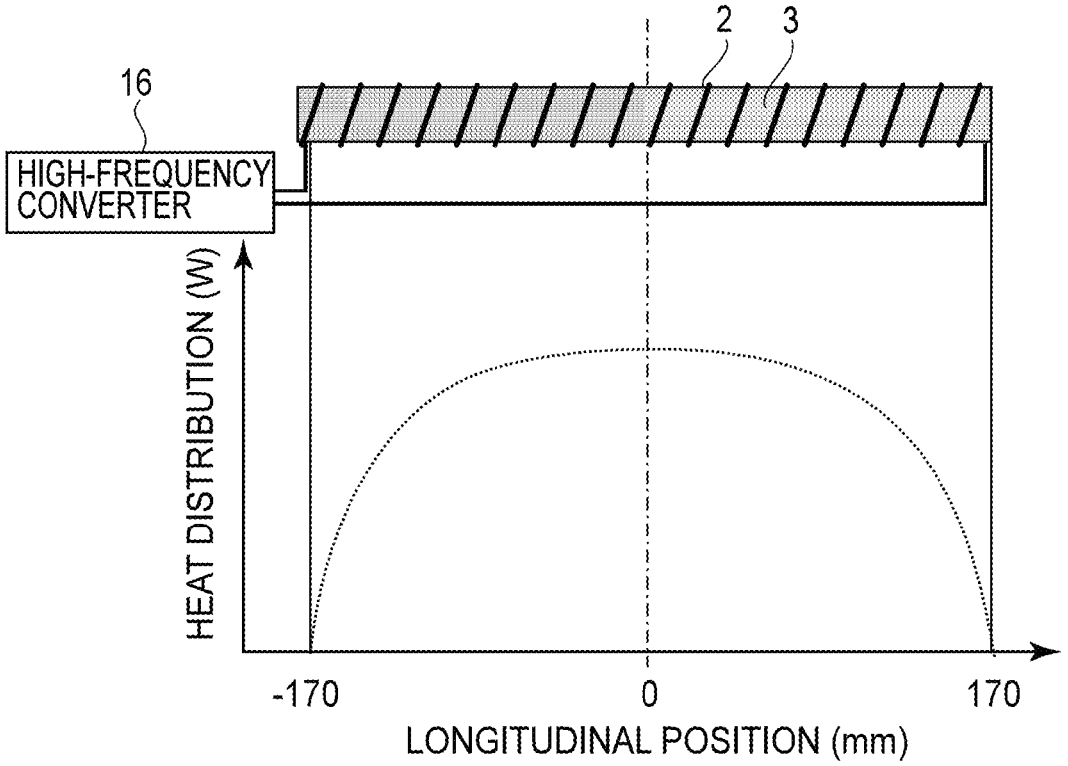
FIG. 12 is a schematic view showing a heat generation amount distribution.

In the constitution in this embodiment, although the downsizing can be realized by employing the open magnetic path, the heat generation amount deceases in the neighborhood of the end portions of the magnetic core 2 as shown in FIG. 12, so that there is the problem of heat generation non-uniformity with respect to the longitudinal direction. Then, at a portion where the heat generation amount of the sleeve 1 is small, improper fixing of the toner is caused, and thus excessive fixing is performed at a portion where the heat generation amount is large, so that an image defect is caused. The reason why the heat generation non-uniformity is generated with respect to the longitudinal direction of the sleeve 1 is that it is naturally associated largely with the formation of the open magnetic path by the magnetic core 2.

Specifically, the following factors 6-1) and 6-2) are associated with the generation of the heat generation non-uniformity.

6-1) Decrease in apparent permeability at magnetic core end portions.

6-2) Decrease in synthetic impedance at magnetic core end portions

Hereinafter, details will be described.

6-1) Decrease in apparent permeability at magnetic core end portions

Figure 13:
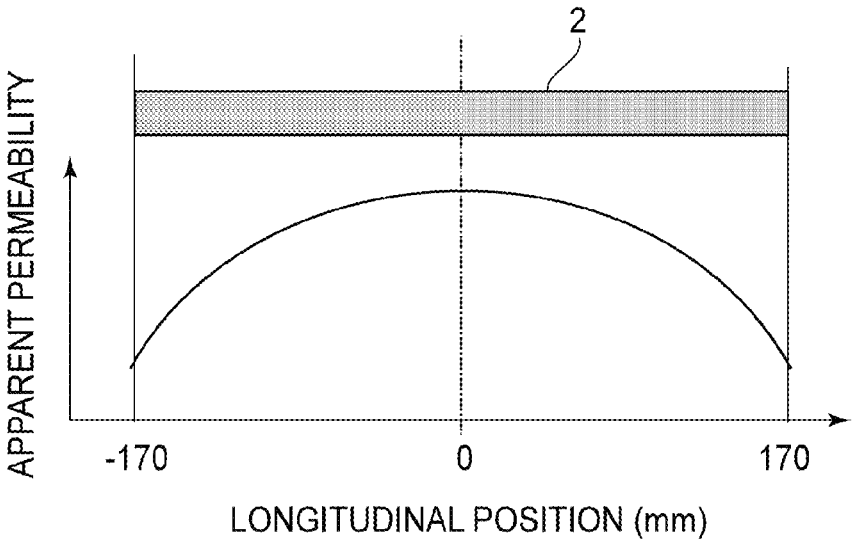
FIG. 13 is a schematic view for illustrating a phenomenon that an apparent permeability μ is lowered at magnetic core end portions.

FIG. 13 is a conceptual drawing for illustrating a phenomenon that the apparent permeability μ is lower at the end portions than at the central portion of the magnetic core 2. The reason why this phenomenon is generated will be described specifically.

In a uniform magnetic field H, the space magnetic flow density B in a magnetic field region such that magnetization of an object is substantially proportional to the external magnetic field is represented by the following formula (3).

$$B=\mu H \tag{3}$$

That is, when a substance having high permeability μ is placed in the magnetic field H, it is possible to create the magnetic flow density B having a height ideally proportional to a height of the permeability.

In this embodiment, this space in which the magnetic flow density is high is used as the magnetic path. Particularly, the magnetic path is formed as a closed magnetic path in which the magnetic path itself is formed in a loop or as an open magnetic path in which the magnetic path is interrupted by providing an open end or the like. In this embodiment, the open magnetic path is used as a feature.

Figure 14:
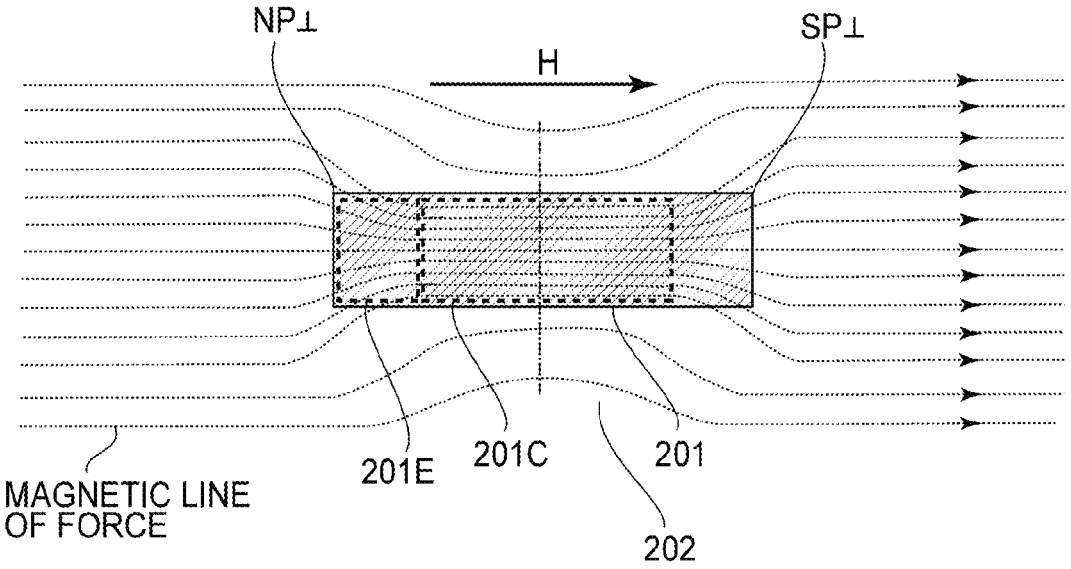
FIG. 14 is a schematic view showing a shape of magnetic flux in the case where ferrite and air are disposed in a uniform magnetic field.

FIG. 14 shows the shape of the magnetic flux in the case where ferrite 201 and the air 202 are disposed in the uniform magnetic field H. The ferrite 201 has the open magnetic path, relative to the air 202, having boundary surfaces NP ⊥ and SP ⊥ perpendicular to the magnetic lines of force. In the case where the magnetic field H is generated in parallel to the longitudinal direction of the ferrite 201, the magnetic lines of force are, as shown in FIG. 14, such that the density is low in the air 202 and is high at a central portion 201C of the ferrite 201. Further, compared with the central portion 201C, the magnetic flow density is low at an end portion 201E of the ferrite 201.

The reason why the magnetic flow density becomes small at the end portion of the ferrite 201 is based on a boundary condition between the air 202 and the ferrite 201. At the boundary surfaces NP⊥ and SP⊥ perpendicular to the magnetic lines of force, the magnetic flow density is continuous, and therefore the magnetic flow density is high at an air portion contacting the ferrite in the neighborhood of the boundary surface and is low at the ferrite end portion 201E contacting the air. As a result, the magnetic flow density at the ferrite end portion 201E becomes small. This phenomenon looks as if the end portion permeability decreases. For that reason, in this embodiment, the phenomenon is expressed as "Decrease in apparent permeability at magnetic core end portions".

Figure 15:
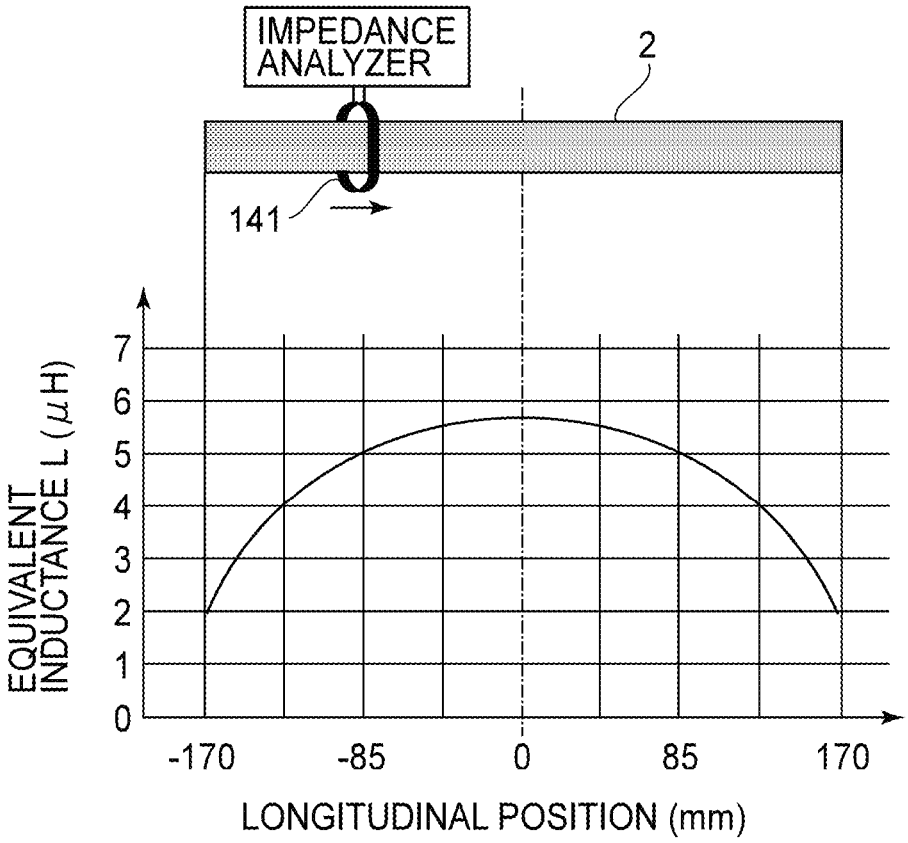
FIG. 15 is a schematic view for illustrating scanning of a magnetic core with a coil.

This phenomenon can be verified indirectly using an impedance analyzer. FIG. 15 is a schematic view for illustrating scanning of the magnetic core 2 with a coil.

In FIG. 15, the magnetic core 2 is inserted into a coil 141 (winding number N: 5) of 30 mm in diameter, and scanning with the coil 141 is made with respect to an arrow direction. In this case, the coil 141 is connected with the impedance analyzer at both ends thereof. When an equivalent inductance L (frequency: 50 kHz) from the both ends of the coil is measured, a mountain-shape distribution as shown in the graph in FIG. 15 is obtained. The equivalent inductance L at each of the end portions of the magnetic core 2 is attenuated to ½ or less of that at the central portion.

The equivalent inductance is represented by the following formula (4).

$$L=\frac{\mu N^2 S}{l} \tag{4}$$

In the formula (4), μ is the magnetic core permeability, N is the winding number, l is the length of the coil, and S is a cross-sectional area of the coil.

The shape of the coil 141 is unchanged, and therefore in this experiment, the parameters S, N and l are unchanged. Accordingly, the mountain-shaped distribution is caused by "Decrease in apparent permeability at member end portions".

In summary, the phenomenon of "Decrease in apparent permeability at magnetic core end portions" appears by forming the magnetic core 2 so as to have the open magnetic path.

Figure 16:
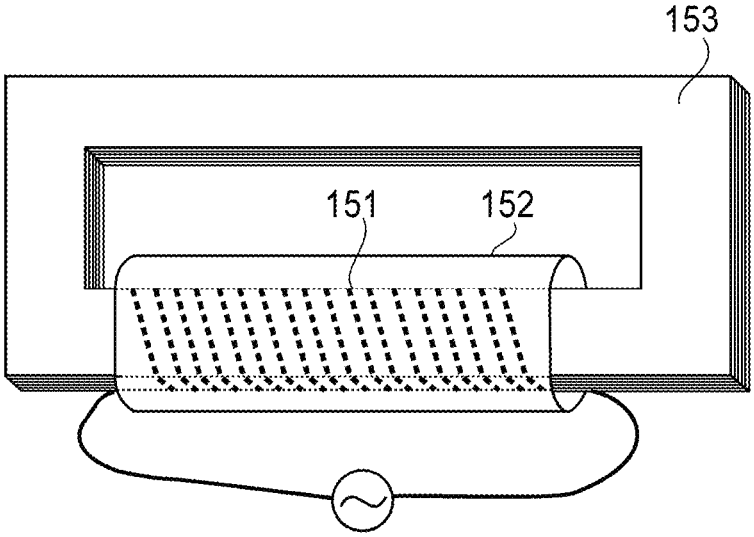
FIG. 16 is an illustration in the case where a closed magnetic path is formed.

In the case of the closed magnetic path, the above phenomenon does not appear. FIG. 16 is an illustration of the case where the closed magnetic path is formed. The case of the closed magnetic path as shown in FIG. 16 will be described.

A magnetic core 153 forms a loop outside an exciting coil 151 and a heat generating layer 152, so that the closed magnetic path is formed. In this case, different from the above-described case of the open magnetic path, the magnetic lines of force pass through only the inside of the closed magnetic path, so that there are no boundary surfaces (NP ⊥ and SP ⊥ in FIG. 14) perpendicular to the magnetic lines of force. Accordingly, it is possible to form a uniform magnetic flow density over the entirety of the inside of the magnetic core 153 (i.e., over a full circumference of the magnetic path).

Figure 17:
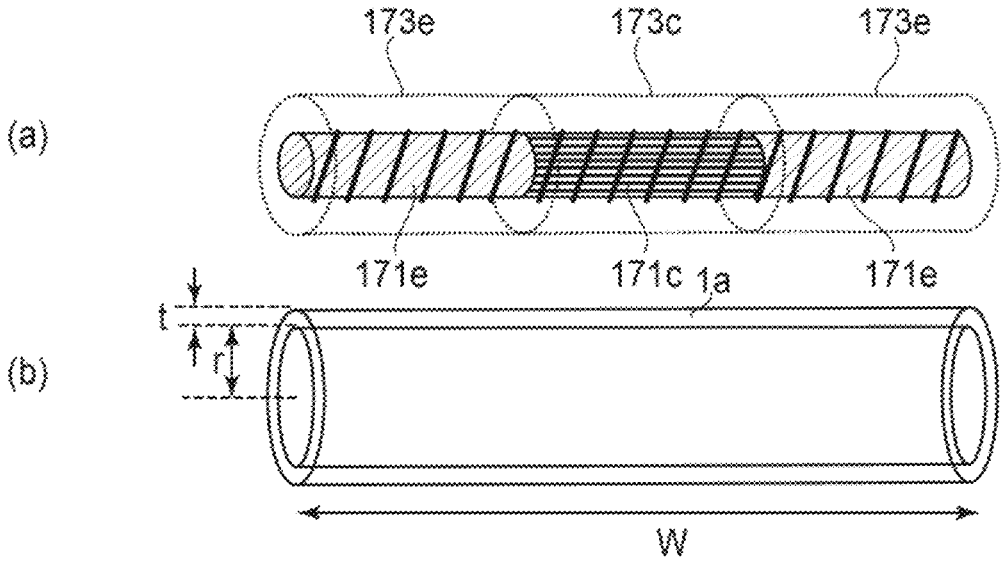
FIG. 17 is an arrangement view of a heat generating layer and a magnetic core divided into three portions.
Figure 18:
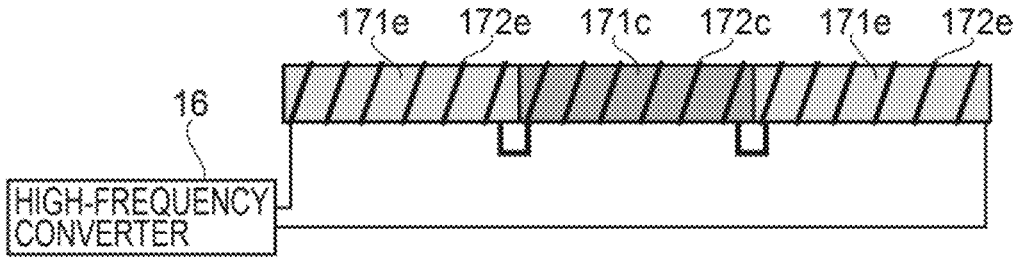
FIG. 18 is an arrangement view of an exciting coil wound around the magnetic core divided into three portions.

In this constitution, the apparent permeability has a distribution with respect to the longitudinal direction. In order to explain this phenomenon by using a simple model, a description will be provided using a constitution shown in FIGS. 17 and 18. FIG. 17 is an arrangement view showing the heat generating layer and the magnetic core divided into three portions. FIG. 18 is an arrangement view showing the exciting coil wound around the magnetic core divided into the three portions.

In (a) of FIG. 17, compared with the constitution shown in FIG. 11, the magnetic core and the heat generating layer are divided into three portions with respect to the longitudinal direction. The heat generating layer includes, as shown in (a) of FIG. 17, two end portions 173*e* and a central portion 173*c* which have the same shape and the same physical property. The resistance value of each end portion 173*e* with respect to the circumferential direction is Re, and the resistance value of the central portion 173*c* with respect to the circumferential direction is Rc. The phrase "circumferential direction resistance" means a resistance value in the case where a current path is formed with respect to the circumferential direction of the heat generating layer.

When the resistance with respect to the circumferential direction is R, as shown in (b) of FIG. 17, the resistance R can be represented by the following formula in the case where the heat generating layer 1*a* is ρ in volume resistivity, t in thickness, r in radius and w in longitudinal length.

$$R=\rho\frac{2\pi\Gamma}{tw}(\Omega)$$

The circumferential direction resistance is the same value, i.e., Re=Rc(=R).

The magnetic core includes, as shown in (a) of FIG. 17, the two end portions 171*e* (permeability: μe) and the central portion 171*c* (permeability: μc) which have the same shape. The values of the permeability of the end portion 171*e* and the central portion 171*c* satisfy the relationship of: μe (end portion)<μc (central portion). In order to consider the above-described phenomenon based on a simple physical model to the extent possible, a change in individual apparent permeability at the inside of each of the end portion 171*e* and the central portion 171*c* is not considered.

The winding is, as shown in FIG. 18, such that the winding number Ne of each of two exciting coils 172*e* and an exciting coil 171*c* is 6. Further, the exciting coils 172*e* and the exciting coil 172*c* are connected in series.

Figure 19:
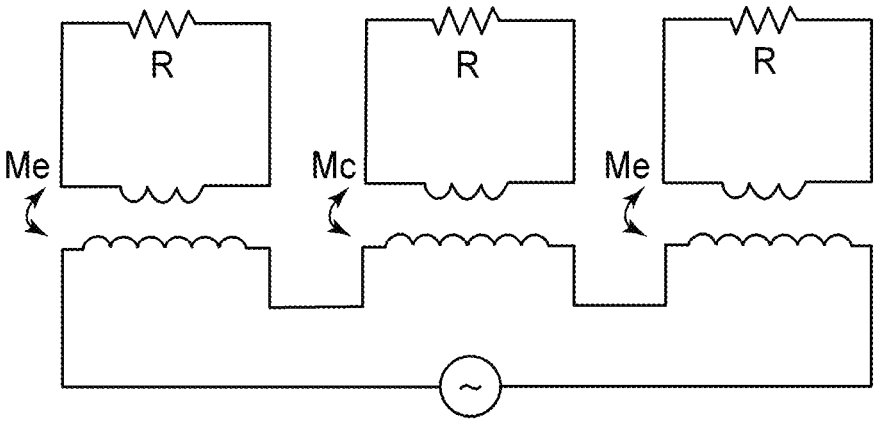
FIG. 19 is a schematic view of an equivalent circuit of the magnetic core and the exciting coil shown in FIG. 18.

Further, the interaction between the exciting coils at the end portion 171*e* and the central portion 171*c* is sufficiently small, so that the above-described divided three circuits can be modeled as three branched circuits as shown in FIG. 19. FIG. 19 is a schematic view showing an equivalent circuit of the model view shown in FIG. 18. The permeability values of the exciting coils satisfy the relationship of: $\mu e<\mu c$, and therefore the relationship of the mutual inductance is also Me<Mc.

Figure 20:
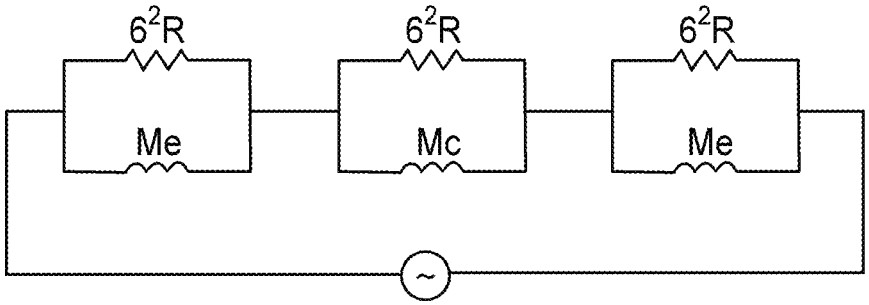
FIG. 20 is a schematic view of an equivalent circuit obtained by simplifying the equivalent circuit shown in FIG. 19.

A further simplified model is shown in FIG. 20. When an equivalent resistance of each of the circuits is seen from the primary side, $R'=6^2R$ holds at the end portions and $R'=6^2R$ holds at the central portion. Therefore, when synthetic impedances Xe and Xc are obtained, Xe and Xc are represented by the following formulas (5) and (6).

$$|X_e| = \frac{1}{\sqrt{\left(\frac{1}{6^2R}\right)^2 + \left(\frac{1}{\omega M_c}\right)^2}} \tag{5}$$

$$|X_c| = \frac{1}{\sqrt{\left(\frac{1}{6^2R}\right)^2 + \left(\frac{1}{\omega M_c}\right)^2}} \tag{6}$$

Figure 21:
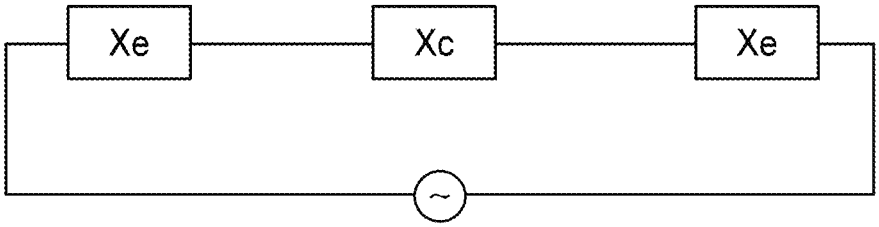
FIG. 21 is a schematic view of an equivalent circuit obtained by simplifying the equivalent circuit shown in FIG. 20.

When a parallel circuit portion of R and L is replaced with the synthetic impedance X, an equivalent circuit as shown in FIG. 21 is obtained. FIG. 21 is a diagram of a further simplified equivalent circuit.

Figure 22:
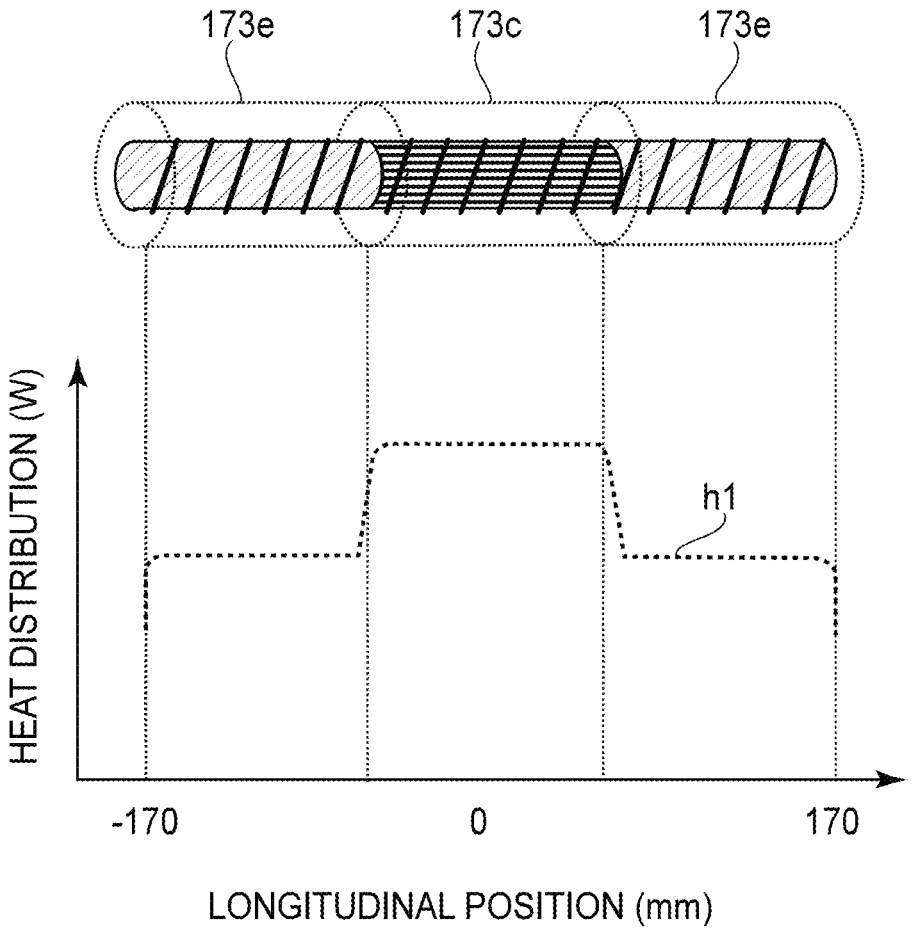
FIG. 22 is a schematic view showing a heat generation amount of a heat generating layer at each of a central portion and end portions.

In FIG. 21, the relationship of the mutual inductance is Me<Mc, and therefore Xe<Xc holds. In the case where the AC voltage is applied from the high-frequency converter, in a series circuit of Xe and Xc shown in FIG. 21, the magnitude relationship of the heat generation amount is determined by the magnitude relationship between Xe and Xc, and therefore the magnitude relationship of the heat generation amount is Qe<Ac. Therefore, when the AC current is passed through the exciting coil 3, as shown by hl in FIG. 22, a mountain-shaped distribution is obtained such that the heat generation amount at each of the end portions 173*e* of the heat generating layer is small and the heat generation amount at the central portion 173*c* of the heat generating layer is large. FIG. 22 is a schematic view showing the heat generation amount of the heat generating layer at each of the central portion 173*c* and the end portions 173*e*.

In the above model, the magnetic core is divided into three portions with respect to the longitudinal direction in order to explain the above-described phenomenon in a simple manner, but in an actual constitution shown in FIG. 11, the change in apparent permeability is continuously generated. Further, the interaction or the like between the inductances with respect to the longitudinal direction would be considered, and therefore a complicated circuit is formed. However, "Reason why heat generation amount lowers in the neighborhood of magnetic core end portions" is described above.

7. Method of Uniformizing Heat Generation Amount

One of means for uniformizing the longitudinal heat generation distribution of the heat generating layer 1*a* is such that the number of winding of the exciting coil 3 is made dense (large) at the end portions of the magnetic core 2 and sparse (small) at the central portion of the magnetic core 2. With respect to the central portion and the end portions, it is possible to change the balance between the inductance and the resistance. This will be described using the above-described model in which the magnetic core and the heat generating layer are divided into the three portions with respect to the longitudinal direction.

Figure 23:
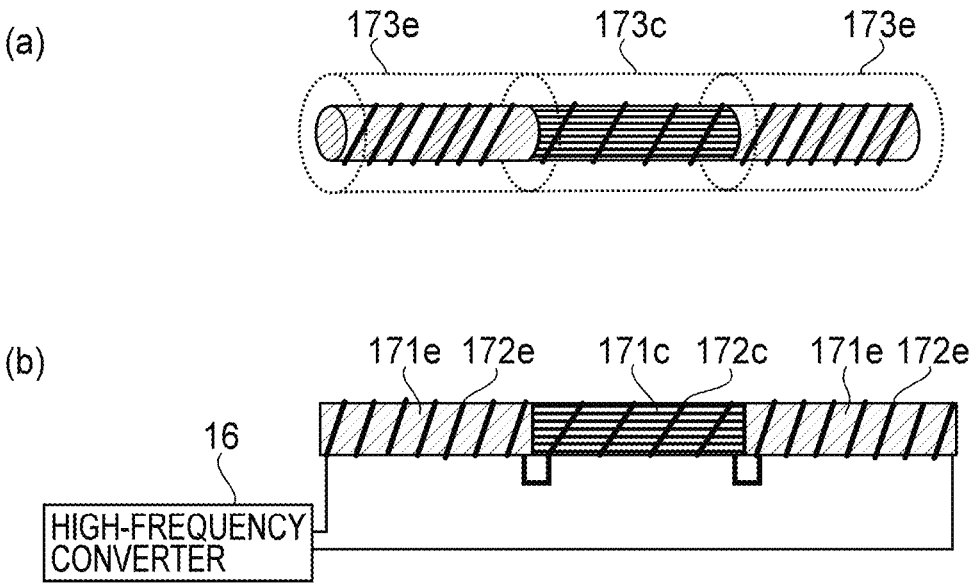
In FIG. 23, (a) and (b) are schematic views each showing a heat generating layer divided into three portions.
Figure 24:
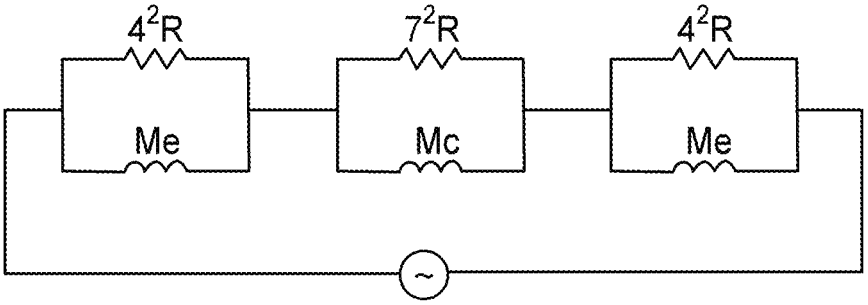
FIG. 24 is a schematic view showing an equivalent circuit of the heat generating layer shown in FIG. 23.

As shown in (a) and (b) of FIG. 23, at each of the end portions 171*e* of the magnetic core, the exciting coil 172*e* is wound in the winding number Ne=7, and at the central portion 171*c* of the magnetic core, the exciting coil 172*c* is wound in the winding number Nc=4. Other constitutions are the same as those in the model of (a) of FIG. 17. A simplified model view is shown in FIG. 24.

When the equivalent resistance of each of the divided three circuits is seen from the primary side, $R'=7^2R$ holds at the end portions and $R'=4^2R$ holds at the central portion. Therefore, when synthetic impedances Xe and Xc are obtained, Xe and Xc are represented by the following formulas (7) and (8).

$$|X_e| = \frac{1}{\sqrt{\left(\frac{1}{7^2R}\right)^2 + \left(\frac{1}{\omega M_c}\right)^2}} \tag{7}$$

$$|X_c| = \frac{1}{\sqrt{\left(\frac{1}{7^2R}\right)^2 + \left(\frac{1}{\omega M_c}\right)^2}} \tag{8}$$

Figure 25:
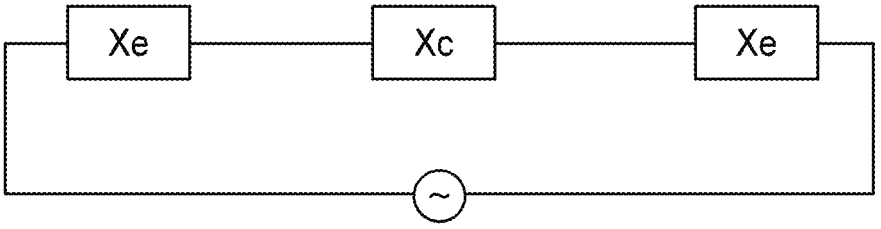
FIG. 25 is a schematic view showing an equivalent circuit obtained by simplifying the equivalent circuit shown in FIG. 24.

When a parallel circuit portion of R and L is replaced with the synthetic impedance X, an equivalent circuit as shown in FIG. 25 is obtained. FIG. 25 is a diagram of a further simplified equivalent circuit. In this way, by adjusting the winding manner of the exciting coil 3, Xe=Xc is caused to hold, so that Qe=Qc can be realized.

However, the winding manner such that the number of winding of the exciting coil 3 is dense (large) at the end portions and sparse (small) at the central portion involves the following problems.

A first problem is that there is a need to ensure an end portion space in order to dense (increase) the number of windings of the exciting coil 3 at the end portions of the magnetic core 2. In order to uniformize the longitudinal heat generation distribution of the heat generating layer 1*a*, the exciting coil 3 is so dense (increased in winding number) at the end portions that the magnetic core 2 and the exciting coil 3 have to protrude from the end portions of the sleeve 1 in some cases. This leads to upsizing of the fixing device A.

A second problem is that in such a winding manner of the exciting coil 3, the heat generation distribution is liable to fluctuate relative to a fluctuation in circumferential direction resistance and thus is unstable. This second problem will be described specifically in Embodiment 2 appearing hereinafter.

In view of these problems, in this embodiment, uniformization of the longitudinal heat generation distribution of the heat generating layer 1*a* in a constitution in which the exciting coil 3 is wound at uniform intervals without protruding of the magnetic core 2 and the exciting coil 3 from the end portions of the magnetic core 2 will be described.

From the formulas (5) and (6), satisfaction of Xe<Xc was described. Here, in order to uniformize the heat generation distribution, a condition in which Xe is nearly equal to Xc will be considered. Assuming that Xe=Xc holds, i.e., that the right sides of the formulas (5) and (6) are equal to each other, when the formulas are reformatted, the following relational expression (9) holds.

$$1+\left(\frac{6^2R}{\omega Mc}\right)^2=1+\left(\frac{6^2R}{\omega Me}\right)^2 \quad (9)$$

The formula (9) holds if Me=Mc is satisfied, but does not hold in general since Me<Mc is satisfied as described above. However, when R/ω approaches 0 without limit, the formula (9) holds.

In other words, with a larger f/R, Xe=Xc tends to hold, i.e., the longitudinal heat generation distribution approaches a uniform state. Here, f is the frequency of the AC magnetic field, and ω=2πf holds. Further, R is the circumferential direction resistance described above.

Next, in order to check whether or not the longitudinal heat generation distribution of the heat generating layer 1*a* is determined, conditions under which an experiment is conducted are shown in Table 6.

TABLE 6

| | WR*1 | T*2 | R*3 | L*4 | CDR*5 | F*6 | f/R |
|---|---|---|---|---|---|---|---|
| | SYMBOL | | | | | | |
| | ρ | t | r | w | R | f | f/R |
| | UNIT | | | | | | |
| No. | Ω/cm | μm | mm | mm | mΩ | kHz | kHz/mΩ |
| 1 | 8.45E−7 | 35 | 12 | 340 | 5.41 | 46 | 8.5 |
| 2 | 8.45E−8 | 35 | 12 | 340 | 0.54 | 46 | 85.2 |
| 3 | 4.00E−7 | 35 | 12 | 340 | 2.56 | 46 | 18.0 |
| 4 | 8.45E−7 | 70 | 12 | 340 | 2.7 | 46 | 17.0 |
| 5 | 8.45E−7 | 70 | 12 | 340 | 2.7 | 92 | 34.1 |
| 6 | 4.00E−7 | 70 | 12 | 340 | 1.28 | 46 | 35.9 |
| 7 | 4.00E−7 | 70 | 12 | 340 | 1.28 | 92 | 71.9 |
| 8 | 8.45E−7 | 70 | 12 | 340 | 0.27 | 46 | 170.4 |
| 9 | 8.45E−7 | 35 | 18 | 340 | 8.11 | 46 | 5.7 |
| 10 | 8.45E−7 | 35 | 18 | 340 | 8.11 | 92 | 11.3 |

*1"VR" is the volume resistance.
*2"T" is the thickness of the heat generating layer 1a.
*3"R" is the radius of the heat generating layer 1a.
*4"L" is the longitudinal length of the heat generating layer 1a.
*5"CDR" is the circumferential direction resistance of the heat generating layer 1a.
*6"F" is the frequency.

Figure 26:
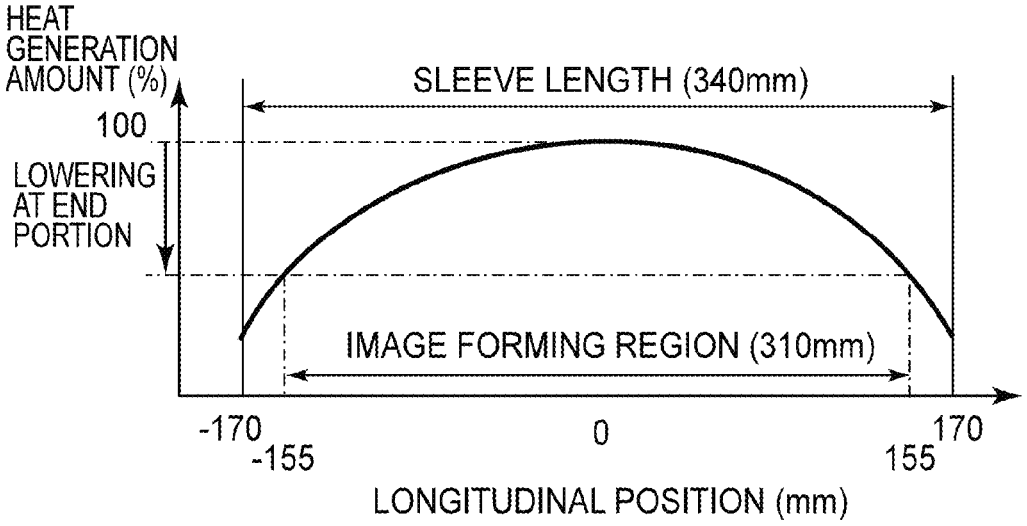
FIG. 26 is a schematic view for illustrating a heat generation lowering amount at end portions.

As a result, the longitudinal heat generation distribution of the heat generating layer 1*a* is obtained as shown in, e.g., FIG. 26, FIG. 26 is a graph for illustrating a heat generation lowering amount at the end portions of the heat generating layer 1*a*, in which the heat generation amount at the longitudinal central portion of the heat generating layer 1*a* is highest, and a distribution when the highest heat generation amount is taken as 100% is shown. Hereinafter, as an index for indicating the longitudinal heat generation distribution of the heat generating layer 1*a*, the end portion heat generation lowering amount is used. The end portion heat generation lowering amount represents the degree of a lowering of heat generation amount at an extreme end portion (position of 155 mm from the longitudinal center) of the image forming region of the sleeve 1 in this embodiment from the heat generation amount (100%) at the longitudinal center of the sleeve 1. That is, with a smaller end portion heat generation lowering amount, the longitudinal heat generation amount of the heat generating layer 1*a* is uniform.

Figure 27:
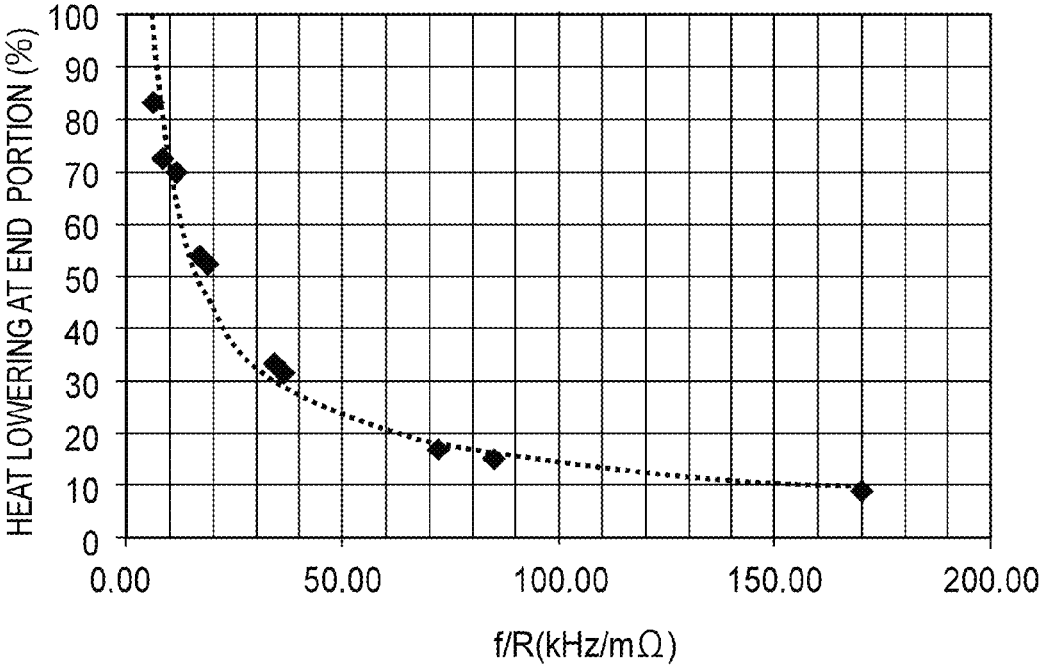
FIG. 27 is a graph showing a relationship between f/R and the heat generation lowering amount at end portions.

A graph in which the end portion heat generation lowering amount is plotted under each of the conditions shown in Table 6 is shown in FIG. 27. As shown in FIG. 27, with a larger value of f/R, the end portion heat generation lowering amount becomes smaller. Thus, it was able to be confirmed that the longitudinal heat generation distribution is determined by the value of f/R.

In this embodiment, for convenience, the condition is changed while fixing the longitudinal length of the heat generating layer 1*a* as shown in FIG. 6, but the relationship between f/R and the end portion heat generation lowering amount is unchanged even when the longitudinal length of the heat generating layer 1*a* is changed. This is confirmed by an experiment by the present invention.

Further, this phenomenon can occur only in the case where members including the air and the magnetic core 2, which are extremely different in permeability, are disposed in the magnetic field region and which have boundary surfaces perpendicular to the magnetic lines of force. For that reason, in the case where a constitution of a blank core consisting only of the exciting coil 3 with no magnetic core 2 is employed, different from the above phenomenon, the apparent permeability is unchanged. Accordingly, a dependency of the heat generation distribution on f/R does not appear. According to the experiment by the present inventors, the relationship between f/R and the end portion heat generation lowering amount obtained in FIG. 27 has not held when the permeability of the magnetic core 2 is 100 or less.

8. Effect of Embodiment 1

Table 7 is a summary of constitutions of Embodiment 1 described above and Comparison Example 1 and the presence or absence of an image defect. Comparison Example 1 is conducted under the condition No. 1 in Table 6. Embodiment 1 is conducted under the condition No. 7 in Table 6. In each of Comparison Example 1 and Embodiment 1, the heat generating layer 1*a* is based on SUS (stainless steel), and a metal film for which the volume resistivity is adjusted by a composition or a manufacturing method is used.

The image defect shown in Table 7 was checked in the following manner. As the recording material P, an A3-sized paper of 80 g/m$^2$ in basis weight was used, and the sleeve 1 was temperature-controlled on the basis of the detection temperature by the temperature sensing element 9 disposed at the longitudinal central portion of the sleeve 1. The control temperature was 200° C., and printing of continuous 10 sheets was performed, and then the image formed on the recording material P was checked by eye observation. The feeding speed of the recording material P was 300 mm/sec. The interval between the recording material P and a subsequent recording material P was 40 mm.

TABLE 7

| | CN*1 | f/R*2 | ST*3 | ID*4 |
|---|---|---|---|---|
| COMP. EX. 1 | 1 | 8.5 | 58 | OCCURRED |
| EMB. 1 | 7 | 71.9 | 168 | NOT OCCURRED |

*1"CN" is the condition No. in Table 6.
*2"f/R" is kHz/milliohm is unit.
*3"ST" is the sleeve temperature (° C.) at the end portions of the image forming region.
*4"ID" is the image defect.

In the following, the generation of the image defect when the end portion temperature of the sleeve 1 is low will be described. Under the conditions in this experiment, a toner was used which causes improper fixing at the sleeve temperature of 166° C. or less and which causes a hot offset at the sleeve temperature of 201° C. or more. The improper fixing was evaluated based on the fixing non-uniformity generated by non-uniform deformation of the toner, glossiness and a fixing property. Further, the phenomenon of a hot offset is an image defect is generated because the toner is excessively melted when the temperature of the sleeve 1 is high, and is deposited on the sleeve 1, and then is transferred and fixed on the recording material P after rotation of the sleeve 1 through one full circumference, to thereby contaminate the recording material P with the toner.

In Comparison Example 1, at the end portions of the image forming region, the sleeve temperature is 58° C., which is very low, and therefore improper fixing occurs. On the other hand, in Embodiment 1, the sleeve temperature is 168° C. at the end portions of the image forming region, and therefore the improper fixing does not occur, and thus a good image can be obtained. From FIG. 27, the condition under which the heat generation distribution that did not generate an image defect was able to be obtained was f/R≥70 (kHz/milliohm).

As described above, the fixing device A in this embodiment can obtain the following three effects under the condition of f/R≥70 (kHz/milliohm). A first effect is that the longitudinal heat generation distribution can be brought near to a uniform state, so that the image defect does not occur. A second effect is that the magnetic core 2 and the exciting coil 3 do not protrude from the end portions of the sleeve 1, and thus downsizing of the fixing device A with respect to the longitudinal direction can be realized. A third effect is that the exciting coil 3 to be wound can be stabilized.

Embodiment 2

Another embodiment of the fixing device A will be described. In this embodiment, first, by using the relationship between f/R and the heat generation distribution described in Embodiment 1, f/R and the winding manner of the exciting coil 3 for uniformizing the longitudinal heat generation distribution of the heat generating layer 1*a* will be described. Next, a relationship between the winding manner of the exciting coil 3 and the stability of the heat generation distribution will be described. In the fixing device A in this embodiment, members which are not mentioned in this embodiment are the same in constitution as those in Embodiment 1.

9. f/R and Winding manner of Exciting Coil

In Embodiment 1, the longitudinal heat generation distribution of the heat generating layer 1*a* can be uniformized under the condition of f/R≥70 (kHz/milliohm) even in the case where the exciting coil 3 is wound at uniform intervals. On the other hand, under the condition of f/R<70 (kHz/milliohm), the longitudinal heat generation distribution can be made uniform by the winding manner of the exciting coil 3 such that the winding number of the exciting coil 3 is dense (large) at the end portions and is sparse (small) at the central portion. This reason was described in "7. Method of uniformizing heat generation amount".

Figure 28:
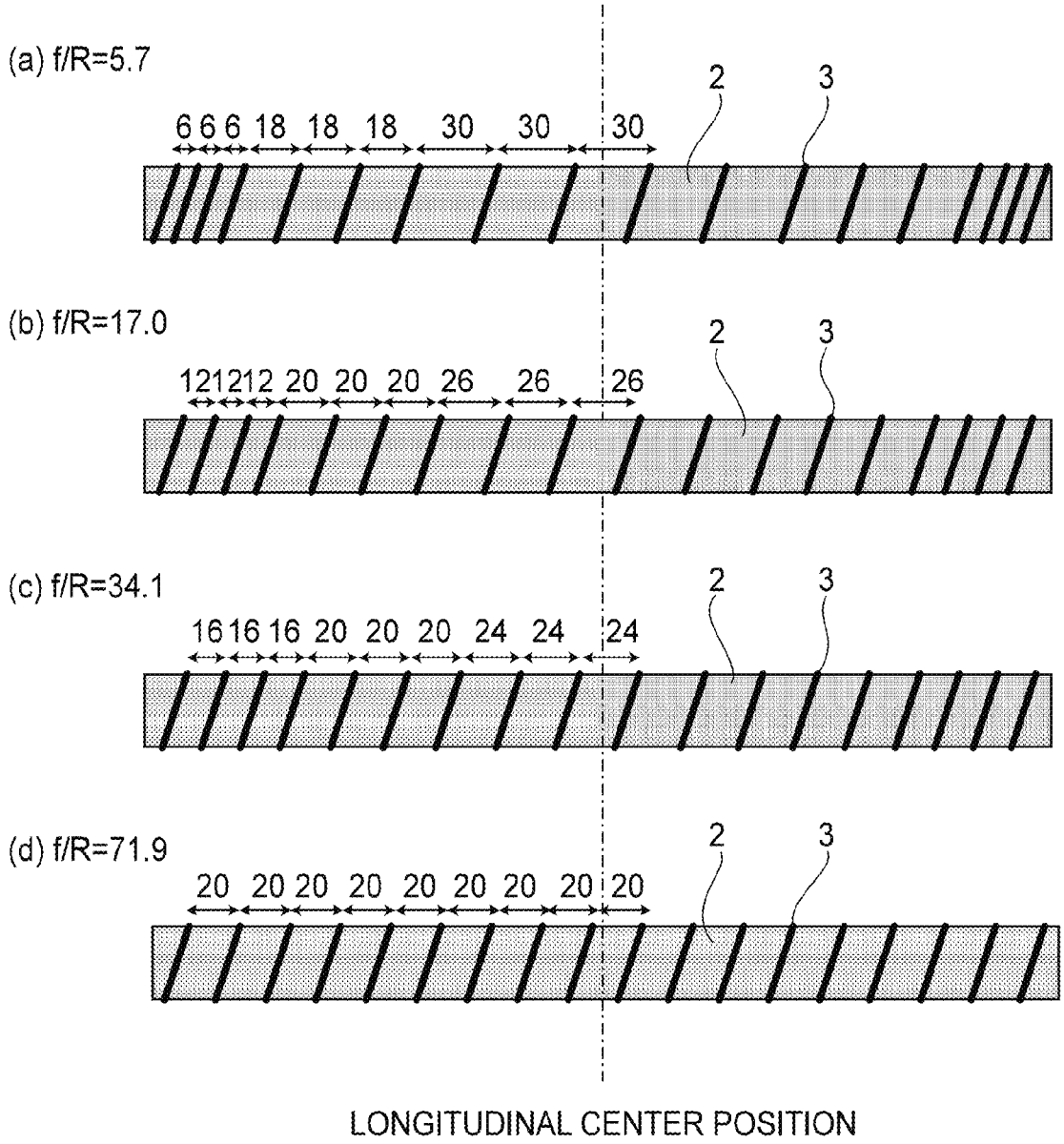
In FIG. 28, (a) to (d) are schematic views each showing f/R and a manner of winding the exciting coil.

In FIG. 28, (a), (b), (c) and (d) show winding manners of the exciting coil 3, in the case where the longitudinal heat generation distribution of the heat generating layer 1*a* becomes uniform, under conditions that f/R is 5.7, 17.0, 34.1 and 71.9 (kHz/milliohm), respectively.

The winding interval of the exciting coil 3 at the end portions of the magnetic core 2 becomes narrower with a smaller value of f/R. As an index for indicating the density of the exciting coil 3 at the end portions of the magnetic core 2, the "end portion coil interval ratio" is defined. The end portion coil interval ratio is a ratio of the winding interval of the exciting coil 3 at each of the end portions of the magnetic core 2 to the winding interval of the exciting coil 3 at the central portion of the magnetic core 2. For example, in (c) of FIG. 28, the interval at the central portion of the magnetic core 2 is 24 mm, and the interval at the end portion of the magnetic core 2 is 16 mm. Therefore, the end portion coil interval ratio is 16/24=0.67.

Figure 29:
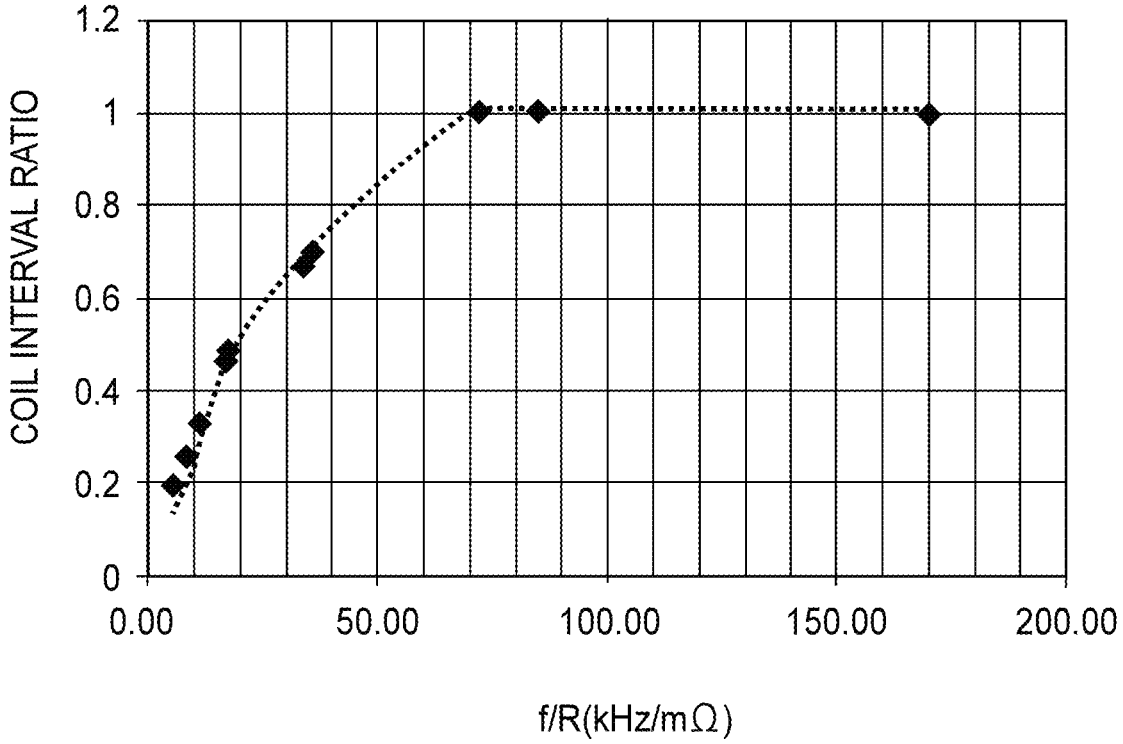
FIG. 29 is a graph showing a relationship between f/R and an exciting coil interval ratio.

FIG. 29 is a graph obtained by plotting a relationship between f/R and the end portion coil interval ratio. When f/R becomes small, the end portion coil interval ratio becomes small. That is, this means that in order to uniformize the longitudinal heat generation distribution of the heat generating layer 1*a*, the exciting coil 3 is required to be wound in a larger number of winding at the end portions.

Figure 32:
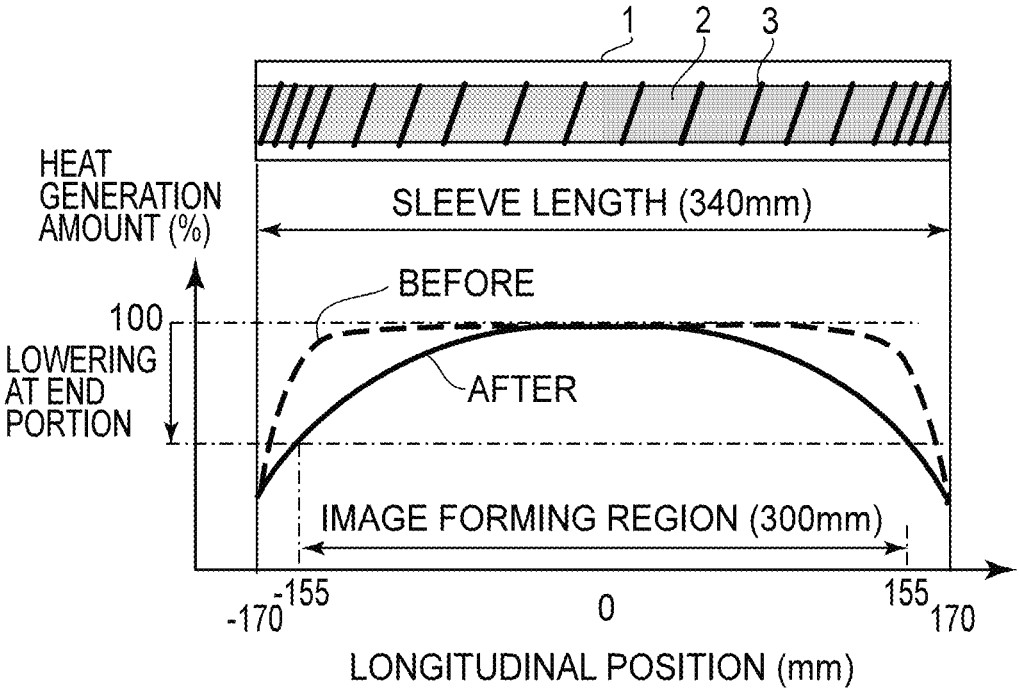
FIG. 32 is a schematic view for illustrating the heat generation lowering amount at end portions when a heat generation distribution changes.
Figure 33:
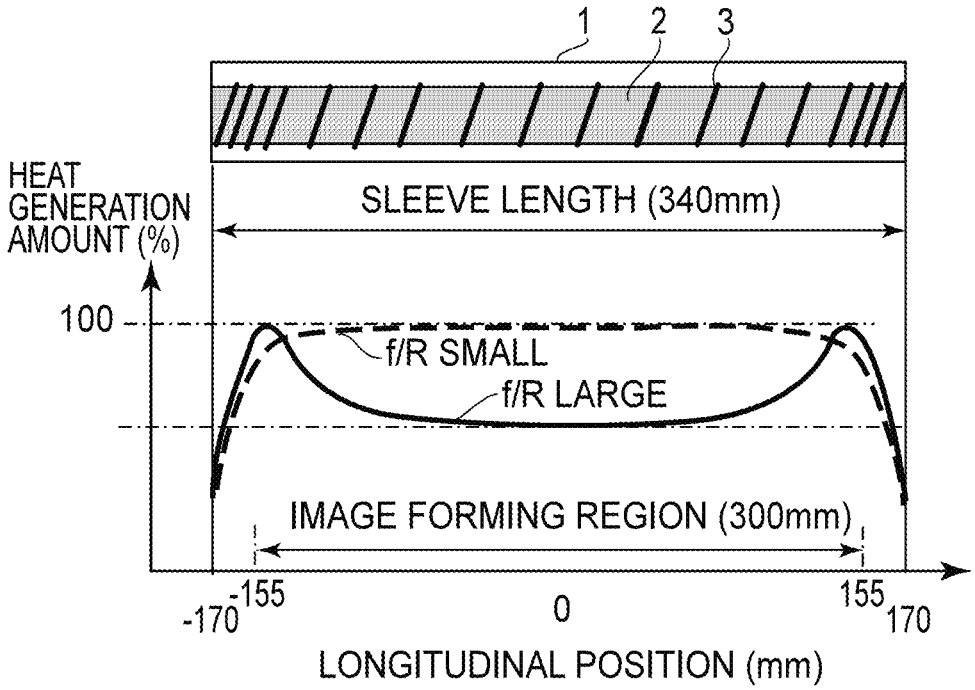
FIG. 33 is a schematic view for illustrating a change in the heat generation distribution.

10. Relationship between Winding Manner of Exciting Coil 3 and Heat Generation Distribution Instability of the longitudinal heat generation distribution of the heat generating layer 1*a* when the exciting coil 3 is wound in the larger number of winding at the end portions of the magnetic core 2 will be described using equivalent circuits shown in FIGS. 30 and 31. FIG. 32 is a graph for illustrating the end portion heat generation lowering amount when the heat generation distribution of the heat generating layer 1*a* fluctuates. FIG. 33 is a graph for illustrating a fluctuation in temperature distribution of the heat generating layer 1*a*.

The heat generating layer 1*a* changes to some extent, in volume resistivity, thickness, radius and longitudinal length, depending on an operation history of the fixing device A. For example, when the rotation operation of the sleeve 1 continues, the heat generating layer 1*a* is abraded (worn) at the end portions by sliding between the flange members 12*a* and 12*b* and the heat generating layer 1*a*, and therefore the longitudinal length of the sleeve 1 becomes short by continuous operation (rotation). Further, due to abrasion (wearing) of the heat generating layer 1*a* at the inner surface by the sliding with the nip forming member 6, the thickness of the heat generating layer 1*a* decreases by the continuous operation.

That is, f/R becomes small by an increase in the circumferential direction resistance R of the heat generating layer 1*a* after the continuous operation, and therefore the longitudinal heat generation distribution of the heat generating layer 1*a* changes into a distribution such that the end portion temperature is low. In this embodiment, the circumferential direction resistance R of the heat generating layer 1*a* becomes large such that the circumferential direction resistance R is 1.2 times the circumferential direction resistance R to the maximum before the continuous operation.

Further, in the case where the volume resistivity, thickness, radius and longitudinal length of the heat generating layer 1*a* have tolerances in manufacturing to some extent, f/R becomes large in some cases. In such cases, as shown in FIG. 33, the longitudinal heat generation distribution of the heat generating layer 1*a* changes to a distribution such that the end portion temperature increases.

Next, by taking, as an example, the case where the circumferential direction resistance roller is 1.2 times the circumferential direction resistance R to the maximum before the continuous operation, the dependency of a degree of a change in longitudinal heat generation distribution of the heat generating layer 1*a* on the winding manner of the exciting coil 3 will be described.

Figure 30:
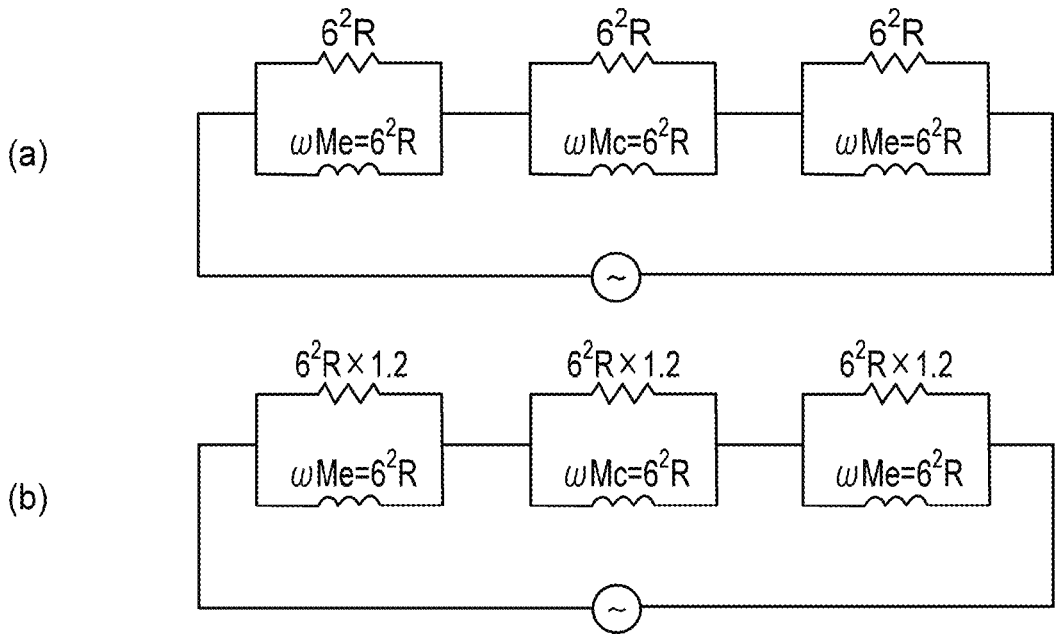
In FIG. 30, (a) and (b) are schematic views each showing an equivalent circuit.

This will be described based on the equivalent circuit in the model in which the magnetic core 2 is divided into the three portions with respect to the longitudinal direction as shown in FIG. 20. In FIG. 30, (a) and (b) are equivalent circuits in the case where the exciting coil 3 is wound around the magnetic core 2 at uniform intervals. In FIG. 30, (a) shows a state before the continuous use. In (a) of FIG. 30, in order to simplify a calculation, $\omega Me=\omega Mc=6_2R$ is used. In this case, the impedance of the heat generating layer 1*a* is the same between central portion and each of the end portions, and therefore the heat generating layer 1*a* uniformly generates heat.

In FIG. 30, (b) shows a state after the continuous operation, and the circumferential direction resistance R is 1.2 times the circumferential direction resistance R before the continuous operation. In this case, at each end portion and the central portion, the impedance of the heat generating layer 1*a* is also the same, and therefore the heat generating layer 1*a* uniformly generates heat.

Figure 31:
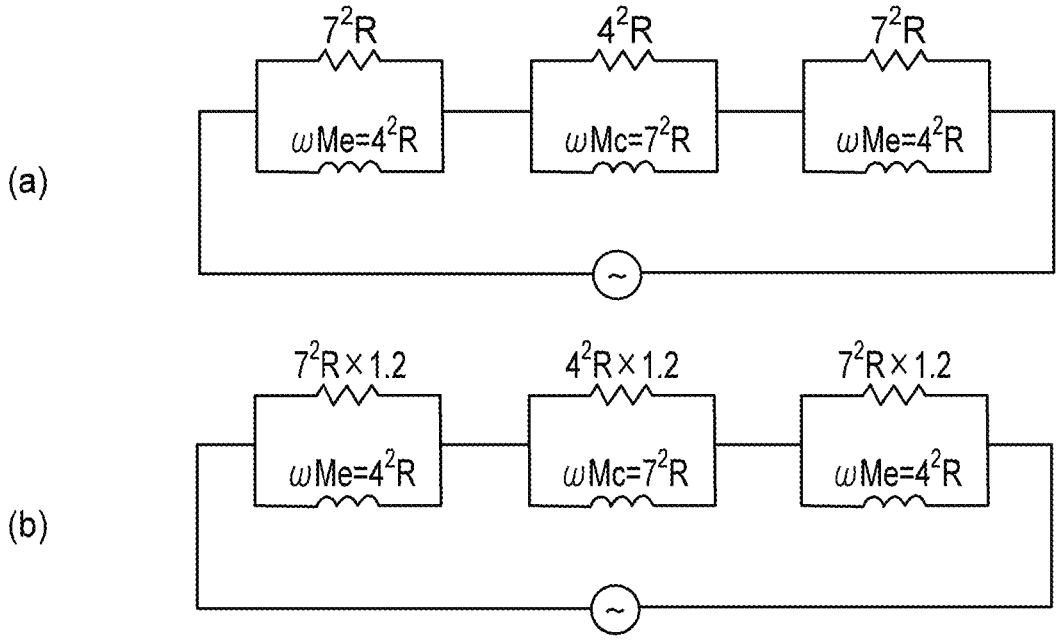
In FIG. 31, (a) and (b) are schematic views each showing an equivalent circuit.

In FIG. 31, (a) and (b) are equivalent circuits in the case where the exciting coil 3 is wound densely around the magnetic core 2 at the end portions of the magnetic core 2. In FIG. 31, (a) shows a state before the continuous use, and similarly as in Embodiment 1, in order to simplify a calculation, $\Omega Me=4_2$ and $\Omega Mc=7_2R$ are used. In this case, the impedance of the heat generating layer 1*a* is the same between central portion and each of the end portions, and therefore the heat generating layer 1*a* uniformly generates heat.

In FIG. 31, (b) shows a state after the continuous operation, and the circumferential direction resistance R is 1.2 times the circumferential direction resistance R before the continuous operation. In this case, synthetic impedances Xe and Xc at each end portion and the central portion are calculated using the formulas (5) and (6), so that the following formulas (10) and (11) are obtained.

$$|X_e| = \frac{1}{\sqrt{\left(\frac{1}{7^2R\times 1.2}\right)^2+\left(\frac{1}{4^2R}\right)^2}} = 15.3R \tag{10}$$

$$|X_c| = \frac{1}{\sqrt{\left(\frac{1}{4^2R\times 1.2}\right)^2+\left(\frac{1}{7^2R}\right)^2}} = 16.5R \tag{11}$$

From the formulas (10) and (11), the end portion impedance Xe is smaller than the central portion impedance Xc, and therefore the end portion heat generation amount is smaller than the central portion heat generation amount.

As described above, as shown in FIG. 32, in order to uniformize the longitudinal heat generation distribution of the heat generating layer 1*a* before the continuous operation, the exciting coil 3 is wound densely at the end portions of the magnetic core 2. In that case, after the continuous operation, the end portion impedance of the magnetic core 2 is liable to lower, so that the heat generation distribution is obtained such that the end portion heat generation amount is smaller than the central portion heat generation amount.

In the following, as an index for indicating whether or not the longitudinal heat generation distribution is uniform when the circumferential direction resistance R after the continuous use is 1.2 times the circumferential direction resistance R before the continuous use, the end portion heat generation lowering amount shown in FIG. 32 is used. The end portion heat generation lowering amount represents the degree of lowering of the maximum heat generation amount at an extreme end portion (position of 155 mm from the longitudinal center) of the image forming region of the sleeve 1 in this embodiment from the heat generation amount at the longitudinal center of the sleeve 1. That is, with a larger end portion heat generation lowering amount, the longitudinal heat generation amount of the heat generating layer 1*a* fluctuates before and after the continuous operation and thus is unstable.

Figure 34:
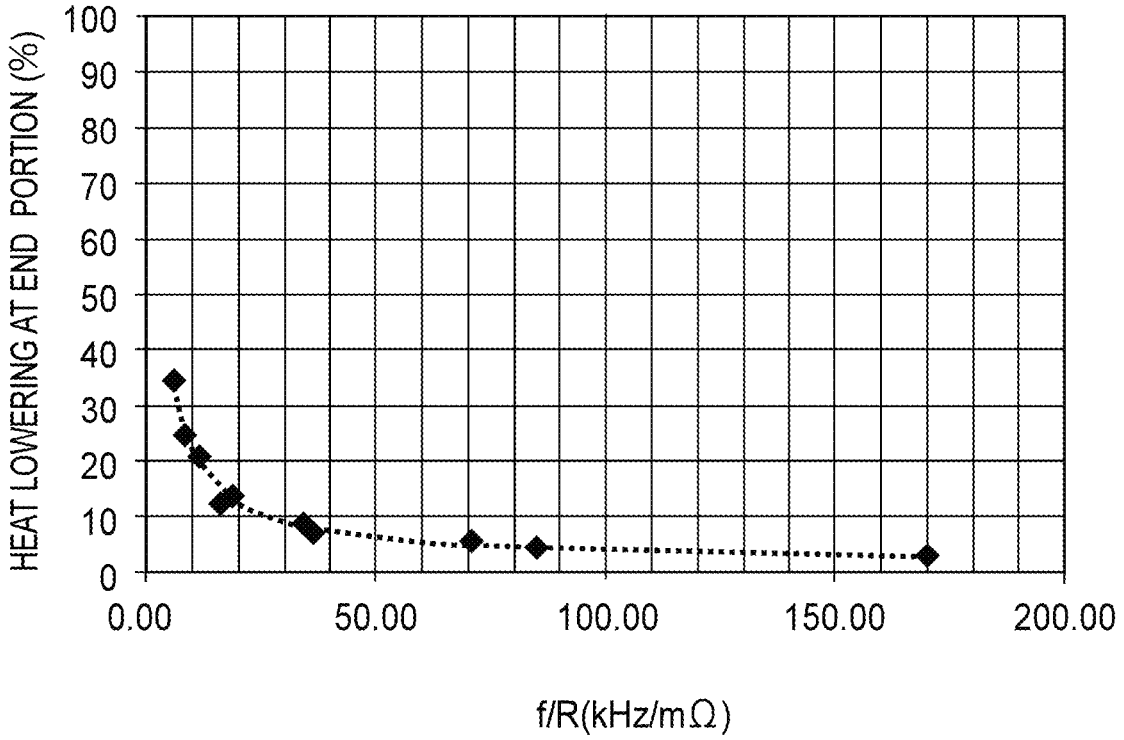
FIG. 34 is a graph showing a relationship between f/R and the heat generation lowering amount at end portions.

A graph in which a relationship between the end portion heat generation lowering amount and f/R is plotted in the constitution in which the exciting coil 3 is wound at the end portion coil interval ratio shown in FIG. 29 is shown in FIG. 34. As shown in FIG. 34, with a larger value of f/R, the end portion heat generation lowering amount becomes smaller. Thus, when f/R is large, the end portion coil interval ratio for the exciting coil 3 for uniformizing the longitudinal heat generation distribution of the heat generating layer 1*a* before the continuous operation can be made large, and therefore the heat generation distribution after the continuous operation does not readily fluctuate.

11. Effect of Embodiment 2

Table 8 is a summary of constitutions of Embodiment 2 described above and Comparison Example 2 and the presence or absence of an image defect. Comparison Example 1 is conducted under the condition that f/R before the continuous operation is 5.7 (kHz/milliohm) and the exciting coil 3 is wound around the magnetic core 2 as shown in (a) of FIG. 28. Embodiment 1 is conducted under the condition that f/R before the continuous operation is 17.0 (kHz/milliohm) and the exciting coil 3 is wound around the magnetic core 2 as shown in (b) of FIG. 28.

The image defect shown in Table 8 was checked in the following manner. As the recording material P, an A3-sized paper of 80 g/m$^2$ in basis weight was used, and the sleeve 1 was temperature-controlled on the basis of the detection temperature by the temperature sensing element 9 disposed at the longitudinal central portion of the sleeve 1. The control temperature was 200° C., and continuous printing of 10 sheets was made, and then the image formed on the recording material P was checked by eye observation. The sleeve 1 is in a state in which the circumferential direction resistance R of the heat generating layer after the continuous operation is 1.2 times the circumferential direction resistance R before the continuous operation. The feeding speed of the recording material P was 300 mm/sec. An interval between the recording material P and a subsequent recording material P is 40 mm.

TABLE 8

| | CWM*1 | f/R*2 | ST*3 | ID*4 |
|---|---|---|---|---|
| COMP. EX. 2 | (a) | 5.7 | 130 | OCCURRED |
| EMB. 2 | (b) | 17.0 | 171 | NOT OCCURRED |

*1"CWM" is the coil winding manner of the exciting coil 3 in FIG. 28.
*2"f/R" is kHz/milliohm is unit.
*3"ST" is the sleeve temperature (° C.) at the end portions of the image forming region.
*4"ID" is the image defect.

In the following, generation of the image defect when the end portion temperature of the sleeve 1 is low will be described. Under the conditions in this experiment, a toner causes improper fixing at the sleeve temperature of 166° C. or less and causes a hot offset at the sleeve temperature of 201° C. or more. The improper fixing was evaluated based on fixing non-uniformity generated by non-uniform deformation of the toner, glossiness and a fixing property. Further, the phenomenon of a hot offset is an image defect generated because the toner excessively melts when the temperature of the sleeve 1 is high, and is deposited on the sleeve 1 and then is transferred and fixed on the recording material P after rotation of the sleeve 1 through one full circumference to thereby contaminate the recording material P with the toner.

In Comparison Example 2, at the end portions of the image forming region of the sleeve 1, the sleeve temperature is 130° C., which is low, and therefore improper fixing occurs. On the other hand, in Embodiment 2, the sleeve temperature is 171° C. at the end portions of the image forming region of the sleeve 1, and therefore the improper fixing and hot offset do not occur, and thus a good image can be obtained. From FIG.

34, a condition under which the heat generation distribution which did not generate the image defect was able to be obtained was f/R≥15 (kHz/milliohm).

As described above, the fixing device A in this embodiment can obtain the following three effects under the condition of f/R>15 (kHz/milliohm). A first effect is that the longitudinal heat generation distribution can be brought near to a uniform state, so that the image defect does not occur. A second effect is that the magnetic core 2 and the exciting coil 3 do not protrude from the end portions of the sleeve 1, and thus downsizing of the fixing device A with respect to the longitudinal direction can be realized. A third effect is that the end portion coil interval ratio of the exciting coil 3 can be made large, and thus the heat generation distribution of the sleeve 1 can be stabilized to prevent the end portion heat generation amount lowering after the continuous operation of the sleeve 1.

Another Embodiment

The pressing member is not limited to the pressing roller, but may also be a rotatable belt or a non-rotatable member, such as a pad or a plate-shaped member, having a small friction coefficient with the surface of the sleeve 1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 261302/2013 filed Dec. 18, 2013, which is hereby incorporated by reference.

What is claimed is:

1. A fixing device for fixing an image on a recording material by heating the image while feeding, through a nip, the recording material on which the image is formed, said fixing device comprising:

a cylindrical rotatable member having an electroconductive layer;

a magnetic member inserted into a hollow portion of said rotatable member; wherein said magnetic member does not form a loop outside the electroconductive layer;

a coil helically wound outside said magnetic member at the hollow portion, wherein said coil forms an AC magnetic field by a flow of a current therethrough to cause the electroconductive layer to generate heat through electromagnetic induction heating; and a back-up member for forming the nip together with said rotatable member, wherein when a circumferential direction resistance R of the electroconductive layer is represented by the following formula (1), a frequency f of the AC magnetic field and the circumferential direction resistance R satisfy the following formula (2):

$$R=\rho\times 2\pi r/tw \quad (1)$$

$$f/R\geq 15 \text{ (kHz/milliohm)} \quad (2)$$

where ρ is a volume resistivity of the electroconductive layer at a fixing temperature, t is a thickness of the electroconductive layer, r is a radius of the electroconductive layer, and w is a length of the electroconductive layer with respect to a generatrix direction of said rotatable member.

2. The device according to claim 1, wherein the frequency of the AC magnetic field f and the circumferential direction resistance R satisfy the following formula (3):

$$f/R\geq 70 \text{ (kHz/milliohm)} \quad (3).$$

3. The device according to claim 2, wherein with respect to the generatrix direction of said rotatable member, said coil is wound at regular intervals.

4. The device according to claim 1, wherein with respect to the generatrix direction of said rotatable member, the length of said magnetic member is not more than the length of the electroconductive layer.

5. The device according to claim 1, wherein with respect to the generatrix direction of said rotatable member, the number of winding per unit length is larger at an end portion than at a central portion.

6. The device according to claim 1, wherein said rotatable member generates heat by an induced current flowing in a circumferential direction thereof.

7. The device according to claim 1, wherein with respect to the generatrix direction of said rotatable member, in a section from one end to the other end of a maximum region through which the image passes, the magnetic resistance of said magnetic member is 28% or less of the combined magnetic resistance of the magnetic resistance of the electroconductive layer and the magnetic resistance of a region between the electroconductive layer and said magnetic member.

* * * * *